US005375642A

United States Patent [19]

Gaber et al.

[11] Patent Number: 5,375,642

[45] Date of Patent: Dec. 27, 1994

[54] VENETIAN BLINDS

[75] Inventors: Ira Gaber, West Norwalk, Conn.; Cooper C. Woodring, Topeka, Kans.

[73] Assignee: Better Mousetraps, Inc., West Norwalk, Conn.

[21] Appl. No.: 979,646

[22] Filed: Nov. 20, 1992

[51] Int. Cl.[5] ..... E06B 9/30

[52] U.S. Cl. ..... 160/168.1; 160/236

[58] Field of Search ..... 160/168.1, 176.1, 173, 160/178.1, 236, 172, 177

[56] References Cited

U.S. PATENT DOCUMENTS

| | | | |
|---|---|---|---|
| 1,112,071 | 12/1914 | Knopf . | |
| 1,590,886 | 6/1926 | Carella . | |
| 2,017,210 | 10/1935 | Kirsch . | |
| 2,053,220 | 9/1936 | Howard | 160/176.1 X |
| 2,162,226 | 6/1939 | McKinney . | |
| 2,220,064 | 11/1940 | Clark | 160/176.1 X |
| 2,251,363 | 8/1941 | McGrew . | |
| 2,276,425 | 3/1942 | Slattery . | |
| 2,280,931 | 4/1942 | Rice . | |
| 2,285,033 | 6/1942 | Judels et al. . | |
| 2,413,464 | 12/1946 | Nihon | 160/176.1 X |
| 2,459,517 | 1/1949 | Gearhart . | |
| 2,543,097 | 2/1951 | Drefke . | |
| 2,570,608 | 9/1951 | Spiegel . | |
| 2,670,037 | 2/1954 | Hunter . | |
| 3,032,099 | 5/1962 | Croxen . | |
| 3,074,127 | 1/1963 | Ellis . | |
| 3,122,954 | 3/1964 | Nadosy . | |
| 3,386,490 | 6/1968 | Kandel | 160/178.1 |
| 3,490,515 | 1/1970 | Kandel | 160/178.1 |
| 4,593,738 | 6/1986 | Chi Yu . | |
| 4,625,868 | 12/1986 | Bischof . | |
| 4,795,515 | 1/1989 | Kao et al. . | |
| 4,799,526 | 1/1989 | Reeves . | |
| 4,951,729 | 8/1990 | Chi Yu . | |
| 5,165,459 | 11/1992 | Gaber et al. . | |

*Primary Examiner*—David M. Purol

*Attorney, Agent, or Firm*—George P. Hoare, Jr.

[57] ABSTRACT

A Venetian blind having forwardly cantilevered and rearwardly counter-weighted slats, and at least a partially recessed vertical system connected to the slats for raising and lowering the slats independently of their tilted position and for spacing, supporting and tilting the cantilevered slats from an essentially horizontal open viewing position to a forwardly tilted fully sealed position (e.g., full or none), and wherein the vertical system is hidden from view when the slats are in their sealed position, to thereby provide a clean blind appearance. The Venetian blind raises and lowers the blind independently of the position of its tiltable slats and hides the vertical members and cords of the recessed vertical system and their respective slat openings in the slats from view from at least one side, preferably from the room interior, when the slats are in their fully sealed position. The interacting elements of the Venetian blind provide a Venetian blind that has great versatility, is attractive, and has room darkening and privacy features.

25 Claims, 20 Drawing Sheets

10

12
26
20
66
22
58
22
26
20
66
18
18
26
16
60
39
32
14
39

16
22
26
20
98
40
39
96
56
94
48
46
96
56
94
48
46
52
32
97

VENETIAN BLINDS

FIELD OF INVENTION

This invention relates to Venetian-type blinds and more specifically to blinds having slats which can be raised and lowered independently of the tilted position of the slats and which hide their vertical members and corresponding slat openings from view when tilted to their sealed slat position. This invention also relates to Venetian blinds which provide the user with, among other things, the ability to conveniently adjust the amount of light and view passing into the room through the blinds from "full" to "none."

BACKGROUND OF THE INVENTION

Introduction

Venetian blinds date back to Marco Polo and Venice. Many suspect Marco Polo "discovered" the Venetian blind in Persia where it was known as a Persiana blind and caused the blind to become popular by introducing it to more populated and commercialized areas.

Evidence exists that the technical construction of the Venetian blind has not substantially changed in over 200 years. The earliest surviving mechanical drawing of a Venetian blind is believed to be by Roubo in *L'Art du Menuisier,* Paris, 1769. It shows a suspended and tiltable multiple slat blind that raises and lowers.

John Webster advertised in the *Philadelphia Journal* on Aug. 20, 1767, " . . . the newest invented Venetian sun blinds for windows, on the best principles, stained to any color, moves to any position, so as to give different lights, screens from the scorching rays of the sun, draws a cool air in hot weather, draws up as a curtain, and prevents from being overlooked, and is the greatest preserver of furniture of anything of the kind ever invented."

An engraving by Robert Edge Pine and Edward Savage of *Congress Voting Independence* shows Venetian blinds in Independence hall in Philadelphia in 1776.

Since its beginnings numerous Venetian blind developments have not significantly changed this classic product other than on a refined scale such as narrow ladder cords replacing wide ladder tapes, conversion to contemporary materials such as aluminum and plastics, and component improvements such as high-ratio gear wands replacing direct-drive tilt cords.

There appears to be at least two causes for the lack of quantum-leap improvements. One is that Venetian blinds have been the subject of consistent refinement over such a long time by so many contributors they were believed to have evolved to their most efficient generic form. In such an environment it is extremely difficult to bring about a revolutionary improvement to a product that has experienced such evolutionary refinement.

The second cause is that in solving one problem the so called improvements either have inadvertently created another one or have compromised a prior accepted benefit to a level below consumer acceptance.

Illustrative of this dilemma are the blinds of U.S. Pat. Nos. 1,590,886 to Carella and 3,074,127 to Ellis. In each instance efforts were made to have the slats hide the vertical members of the blinds but to do so they required the tilting means to be secured to the bottom casings of the windows. As a consequence the raising and lowering of the slats was prevented, the installments were complicated, and among other things, costs increased, and the blinds would generally require a relatively high degree of window squareness for the product to fit properly.

The point is that continuing efforts to improve Venetian blinds over hundreds of years commonly have not produced acceptable results.

General Description of Venetian Blinds

In general the primary function of a window covering such as a Venetian type blind, is to provide increased privacy and light or view modifying capability in an attractive device complementary to the environment. The function, fashion and cost aspects of a window covering are among the most important purchasing criteria in both the residential and commercial markets.

In the residential market, the need for light and privacy features in a window covering like a Venetian blind and the ability to effectively control them, exceed that of the commercial market. Cycles of adjusting light and privacy conditions tend to increase in those environments where use of a room span both day and night, as is the case in residential bathrooms, bedrooms, kitchens, dining and living rooms.

As a type of window covering Venetian blinds offer versatility in controlling the light or view and are easy to use. Venetian blinds have great appeal and enjoy widespread use in both commercial and residential markets because of these described features, and because they are readily available and are relatively inexpensive. Additionally, Venetian blinds are easy to install, operate reliably and effectively, and in order of declining popularity are available with metal, plastics, wood and other material slats.

A common, commercially available Venetian blind generally includes a head-rail, a bottom-rail, a plurality of slats, means for tilting the slats, a tilt rod, and a means for rotating the tilt rod. The assembled slats and ladders can be referred to as a slat pack. The slat pack cradles each slat on horizontal ladder rungs connected to both of the ladder's vertical members. Raising and lowering the vertical members causes each slat to pivot about a point on the rung. Half the weight of each slat commonly is distributed forward of the pivot point and half the weight of each slat is distributed rearward of the pivot point. The location of both vertical members is equidistant from the slat's longitudinal center line and proximate both the forward and rearward slat edges. Consequently, half the slat's weight rests on the forward vertical member and the other half rests on the rearward vertical member. With the slat in balance about this pivot point and its weight equally distributed between both vertical members, the vertical members become the means to support, space, and tilt or rotate the slats to any given position. This type of blind also can include lift-cords depending from the head-rail and extending through the slats and, generally, between the vertical members. The lift-cords or members are used to raise and lower the blinds independently of the tilting of the slats by the vertical members.

Generally the slats of Venetian blinds are flat or have a slight crown, come in a variety of widths ranging from ½" to 2" or more, and can be found in an extremely wide range of colors and finishes. Slat tilting in a Venetian blind is independent of slat collection and distribution and this dual adjustment system offers the user a considerable advantage in operating either one of the two independent means to control view or light.

Regardless of the size, color, or slat material, today's Venetian blinds commonly have fabric ladders with vertical members, sometimes called rails or tapes, connected to one another by horizontal members, sometimes called rungs. The rungs act to directly support each individual slat in a cradle-like fashion between the rails. These rails indirectly support all the slats and cause them to be tilted in unison. Vertical spacing between slats commonly is about 85% of the front-to-back dimension of the slat with the remaining 15% of the slat overlapping one another when the slats are tilted to their maximum position.

When the cradled slats have been tilted to their maximum position, the support rungs divide and separate the slats and prevent the edge of one slat from making contact with the upper surface of a contiguous lower slats and thereby create spaces between slats that allow light to bleed through. Additionally, Venetian blinds have two or more openings in each slat to accommodate two or more lift-cords. This bleeding light between slats in combination with the light emitted through the two or more openings in each slat prevents these devices from creating a completely room darkening or private condition.

Tilting the slats to adjust the light or view is achieved by raising one vertical member while simultaneously lowering the other. This is usually accomplished with a geared tilting system located in the head-rail. One vertical member's upward movement raises one end of the connecting rung while the other vertical member's simultaneous downward movement lowers the opposing end of the rung and consequently raises and lowers the slats rearward and forward edges.

The vertical members generally are located outside both the front and rear edges of the slats to facilitate the loading of the slats into the ladder. The described vertical members are visible from both sides of the window covering irrespective of the tilt position of the slats and create a very messy and undesirable appearance, particularly when the slats are raised and the vertical members are compressed into approximately 10% of their lowered dimension. At least two visible ladders are used in Venetian blinds, with more in blinds that are wider. This further degrades the appearance of the window covering.

The lift-cords that are required to collect and distribute the slats pass through openings aligned within the slats. Typically, these cords are located therebetween and in alignment with the ladder rail members so as to be partially obstructed from view. Substantial side-to-side clearance is required between the lift-cord and the openings in the slats so as to prevent abrasion and ultimate failure of the lift-cord.

When the slats are tilted to the fully closed position both forward and rearward edges of the openings contact the lift-cord impeding further rotation and thereby prevent the slat's forward edge from contacting the upper surface of the contiguous slat immediately below. This limitation contributes to the considerable dimensional gaps between slats that allows light through the blind into the room. Additionally, the side-to-side clearances provided in the slat openings to accommodate the lift-cord also allow light to pass through and is particularly obvious and annoying when the slats are tilted to their fully sealed position. Sight lines into the room are created through the multitude of holes and openings in every slat, preventing complete privacy.

These light-leakage problems, identified with today's Venetian blinds, prevent them from creating total privacy and a complete room darkening condition.

Drawbacks of Presently Available Venetian Blinds

As we have seen, generally available Venetian blinds are beset with deficiencies despite their popularity and despite the persistence of the previously described problems over an extremely long period of time.

First and probably foremost insofar as the users are concerned, are the vertical members and/or cords which can be seen from the interior view of the blinds. The desire to eliminate viewing of the vertical members and cords is experienced most often when the blind is in its fully sealed position.

Second, users desire 100% room darkening through the window covering. They object to the light-leakage problems experienced with today's Venetian blinds. Users also object to the "peep holes" in Venetian blinds due to the at least two see-through holes in each slat for the vertical members and lift-cords which remain visible in presently available blinds.

This is evidenced by the continuing and unsuccessful efforts to overcome these deficiencies by manufacturers eager to increase their market share in the one and one-half billion dollars per year domestic blind market.

PRIOR ART

The prior art also demonstrates that efforts have been made to overcome the described deficiencies in Venetian blinds.

For example, the previously identified U.S. Pat. No. 1,590,866 issued to Carella on Jun. 29, 1926 and U.S. Pat. No. 3,074,127 issued to Ellis on Jan. 22, 1963 both disclose rotatable window coverings having rotatable louvers. Both devices however require that one vertical tilting means be secured to the window casing at both terminal ends to facilitate tilting the louvers. The securing of the tilting means of the window covering to the bottom casing prevents the louvers from collectively being raised and lowered in a manner convenient to the user and complicates installation.

U.S. Pat. No. 2,251,363 to McGrew issued on Aug. 5, 1941 discloses a horizontal Venetian blind with a plurality of slat supporting chain devices attached to the slats at their interior central pull-cord openings. This device would prevents the edges of each slat from contacting the surfaces of contiguous slats when closed only if the supporting chain and pull-cord dimensions inside the openings were reduced significantly such that they did not impede the tilting of the slats. Additionally, this device would require the number of slats to increase considerably while their spacing would have to decrease in order to permit the slats to cover all central openings. To provide full privacy and room darkening when tilted closed each slat would have to overlap approximately two thirds the width of each contiguous slat. The increased number of slats required in the McGrew device would make it prohibitive in cost and reduce the percent of open-to-view through the window covering to an unacceptable level.

U.S. Pat. No. 2,280,931 issued to Rice on Apr. 28, 1942 discloses a horizontal Venetian Blind wherein the slats are supported on flat members attached to ladder-tapes behind the slats so that the slats are cantilevered entirely forward of the ladder-tapes. The bottom-rail that is attached to the tapes acts as a unified counterweight device to the cantilevered slats which prevent them from automatically tilting downward as a result of gravity acting on their own weight. The Rice window covering makes dual use of the bottom-rail element; first as the lifting component of the collection and distribution system, and secondly as a counter-weight for tilting the cantilevered slats. As a result, a severe limitation exists for the user whereby the slat's angles may only be altered or controlled when the bottom-rail is in the fully lowered position but is not resting on the window sill. If the slats were in the full open-to-view position and the counterweighted bottom-rail partially lifted, the slats would automatically tilt to the fully sealed position.

Thus, despite the desires of consumers, the efforts of manufacturers and others and the early origins of the art, Venetian blinds presently are not available which provide complete room darkening and complete privacy through the blinds, which hide the vertical members and/or cords when the slats are in their closed sealed position and which can be raised and lowered independently of the tilted position of the slats.

SUMMARY OF THE INVENTION

The present invention is directed to a Venetian-type blind that raises or lowers the blind independently of the position of its tiltable slats and that hides the vertical members and cords and respective slat openings from view from at least one side, preferably from the room interior, when the slats are in their fully sealed position. The interacting elements of the blind of the invention provides a new and unique Venetian-type blind that has greater versatility, is more attractive, has greater room darkening and provides greater privacy.

The Venetian blind of the invention includes forwardly cantilevered and rearwardly counter-weighted slats, and at least a partially recessed vertical system operatively connected to the slats for raising and lowering the slats independently of their tilted position and for supporting and tilting the cantilevered slats from an essentially horizontal open viewing position to a forwardly tilted fully sealed position (e.g., full or none), and wherein the vertical system is hidden from the forward view of the slats when they are in their sealed position, to thereby provide a clean blind appearance.

The Venetian blind of the present invention preferably provides the user with a window covering which can include shaped slats of many different shapes, materials and widths, employs two entirely independent light control systems, tilts the slats in unison regardless of the use of or position of the bottom-rail, allows the edges of each slat to contact contiguous slats and thereby prevents light leakage therebetween, completely covers the forward vertical members, the lift-cords and their respective openings from the forward view when the slats are tilted to the fully sealed position, and maintains the number of slats and their spacing to that of today's conventional standards.

The Venetian blinds of this invention when tilted to the fully sealed position has slats that completely darken the room and create a fully private environment through the blinds while concealing all vertical members and cords from inside the room. Also the slats of the present invention generally include a forward edge, a rearward edge and a pivot point. The pivot point is between the edges and is located rearward of the slat's dimensional center.

In a preferred embodiment the Venetian blind of the present invention generally includes a head-rail, a bottom-rail, a plurality of tiltable forwardly cantilevered and rearwardly counterweighted slats, vertical members for supporting and for tilting the slats, and means for raising and lowering the slats independent of the position of the slats. The slats preferably are operatively connected to a pair of vertical members, one forward and one rearward, that serve to space, support and simultaneously tilt the slats. A formula, which will be later described in detail, has been developed to calculate how much and where necessary additional weight should be added to the shorter and previously lighter rearward portion to compensate for the longer and previously heavier forward cantilevered portion to cause the desired forward-edge-up orientation for each entire individual slat. The forward of the two vertical members is disposed between the two edges of each slat and is operatively connected to each slat. The member passes through an opening in each slat that is also disposed between the forward and rearward edges of each slat and is in vertical alignment with similar openings in other slats. The rearward vertical member is operatively connected to the slat and is disposed proximate the rearward edge of the slat. The rearward vertical member can lie outside the rearward edge of the slat or can lie inside the rearward edge of the slat in which case it too would pass through an opening that would also lie inside the rearward edge of the slat and would be in vertical alignment with similar openings in other slats.

The slats of the present invention preferably have a portion of the slat greater than half the dimensional width of the slat which is disposed forward of the forward vertical member toward the room interior (in .other words cantilevered), and a counterweight is provided to the rearward position of each slat such that the total weight rearward of the forward vertical member exceeds the total weight forward of the forward vertical member, thereby making the slat's forward portion lighter in total weight than the heavier rearward portion of the slat.

Normally, in a non-counterweighted slat, the majority of each slat's dimensional width would be disposed forward of the forward vertical member. Each slat would tend to naturally rotate downward about the point at which the slat is operatively connected to the forward vertical member as this longer forward portion of the slat would weigh more than the shorter rearward portion of the slat. The point of rotation would become the pivot point about which the slat would rotate until the forward edge of each slat comes into contact with the upper surface of the contiguous slat immediately below. At this point of contact rotation would cease. With the described counterweight added to the rearward portion of each slat, however, each slat will be caused to naturally rotate in the opposite direction. Each slat's forward edge will naturally want to rotate upwardly as the slat's longer forward portion is lighter in total weight than is the shorter heavier rearward portion of the slat.

This forward-edge-up is the natural balanced or relaxed preferred position of the slats of the invention. Tilting is controlled by lifting the rearward edge of each slat by way of lifting the rearward vertical member, or by lowering the forward vertical member, or by doing both simultaneously. The independent or cooperative movement of the vertical members will determine the specific point of rotation of the slats but in any case the pivot point will be disposed at or between the vertical members.

In the present invention the greater the percentage of each slat's total dimensional width that will be cantilevered forward of the forward vertical member, the greater the spacing can be between the slats. This will result in a lower percentage of slat overlap when rotated to the fully sealed position. In such instance, however, more weight should be added at each slat's rearward portion for counter-balance. Additionally, the further to the rear of the rearward portion the additional weight is added, the less weight will be required.

In the practice of the present invention the slats can be made to comply with the dimensional and weight requirements of the invention in a number of ways. The slats also can be made of metal such as steel or aluminum, plastics such as polycarbonate or vinyl, wood such as bass, or other suitable materials. The slats can be continuously slit from materials having constant wall-thicknesses like roll-formed aluminum or from material having non-constant wall-thicknesses like sheet plastics. Additional weight can be added to the rearward portion of the slats locally or continuously by many methods such as gluing, clamping, riveting, crimping, roll-forming, welding, ultrasonic-welding, etc. The slats can be extruded or coextruded in constant or non-constant wall-thicknesses with separately connected or integrally added additional material for counter-weight, or provisions in the profile for co-extruding or easily capturing additional counter-weight, either locally or continuously, in the same or other materials.

Additionally, all of the required weight that need be added to the existing weight of the rearward portion of each slat to exceed the weight of the forward portion of each slat may be added in a suspended manner by operatively connecting the required weight to the rearward vertical member. In one embodiment weight can be integral with the flexible rearward vertical member.

The two vertical members of the Venetian blinds which provide the described spacing and tilting for each slat, can therefore provide the required additional weight needed between each slats by suspending the needed weight proximate the rear edge of each slat. Additionally, the suspended weight need not be integral with the rearward vertical member.

Vertical members of the present invention can be woven or knitted of synthetic material that are very resistant to stretching and are flexible such that they can be folded in a semi-controlled manner between slats as the blind is compressed upon raising into a small stack height that is often one-tenth the lowered height.

Preferably two or more lift-cords are used for the Venetian blinds of the invention. The lift-cords can be attached to a foot-rail, pass through vertically aligned openings in each slat, pass through the head-rail and exit through a cord-lock or have some other suitable tie-down device.

The openings in the slats of the invention through which the lift-cords pass can be configured in a number of ways. The openings can include the two vertical members, or the openings can be separate from the vertical members, or they can contain either of the vertical members. The opening for each lift cord can be completely contained within the edges of the slats or it can partially contained and have an open exit-way through the rearward edge of the slats.

In sum, the Venetian blinds of the present invention provide a "cordless" appearance at least when the slats are in the closed sealed position and in such position the blinds provide meaningfully greater darkness and privacy than presently available blinds. The Venetian blinds of the invention provide the described benefits of cleaner interior appearance, easier cleaning and maintenance, greater room darkening and greater privacy while including other important benefits of Venetian blinds, such as ease-of-installation, cost, percent open-to-view, the ability to adjust slat angle regardless of elevation of the bottom-rail and to raise or lower the blind independently of the slat angle.

BRIEF DESCRIPTION OF THE DRAWINGS

The following is a detailed description together with accompanying drawings of illustrative embodiments of the invention. It is to be understood that the invention is capable of modification and variation apparent to those skilled in the art within the spirit and scope of the invention.

DETAILED DESCRIPTION OF THE INVENTION

Figure 1:
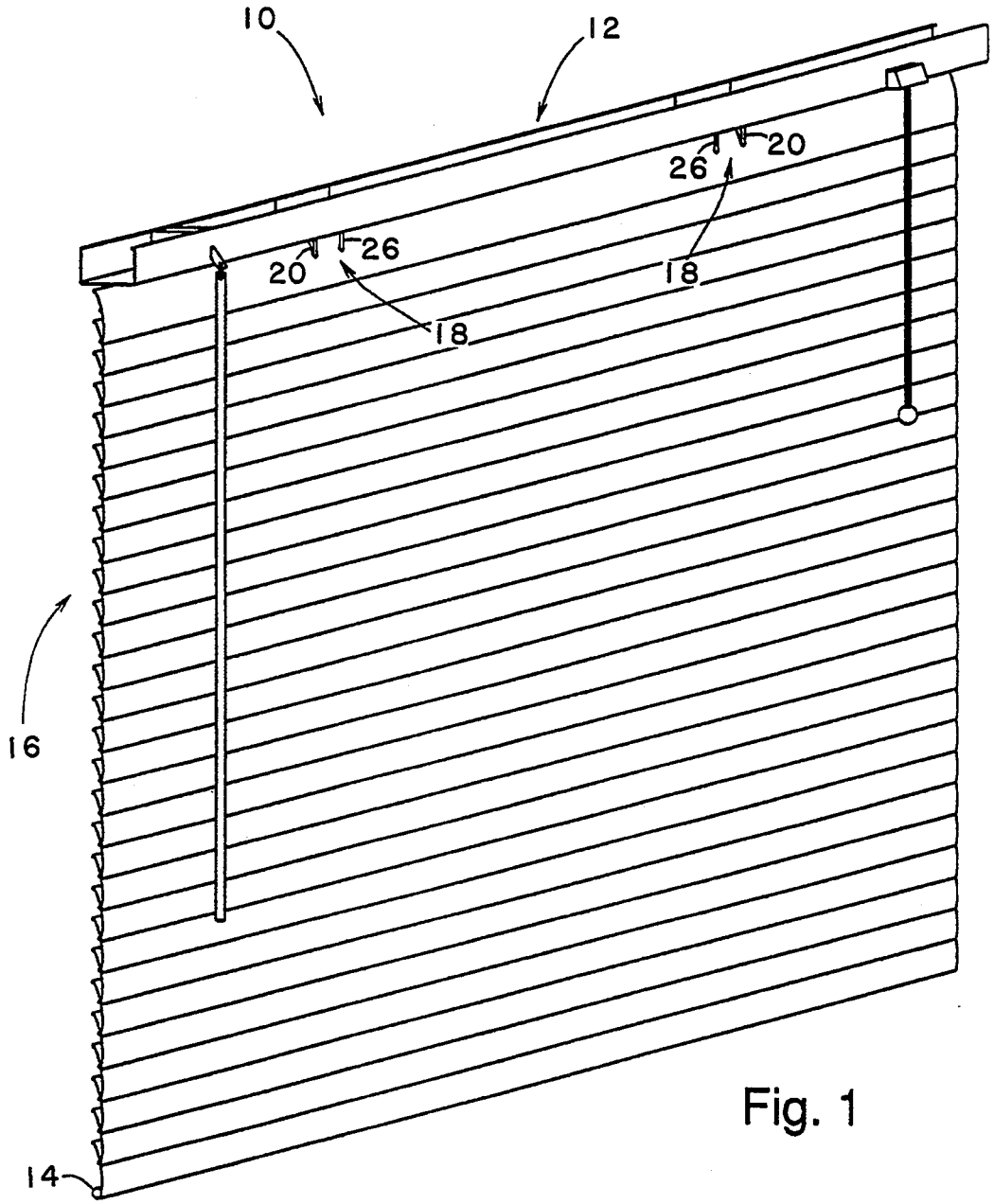
FIG. 1 is perspective view of a general view of the preferred embodiment of the invention in a fully lowered position with the slats in the fully tilted downwardly or sealed position.

Referring to the drawings and first to FIGS. 1–5, there is shown a preferred embodiment of the Venetian blind 10 of the present invention illustrated in various levels of being raised, from fully lowered to partially raised, and in various degrees of slat tilt angle, from fully-tilted downward or sealed, through the full open-to-view position, to being fully tilted upwardly.

The illustrative blind 10 includes a head-rail 12, a bottom-rail 14, forwardly cantilevered and effectively rearwardly weighted slats 16 and a vertical system 18 for tilting the slats 16 and for raising and lowering the blind independent of the position of the slats 16. In this embodiment, the slats 16 are efficiently counter-weighted to normally bias them upwardly, i.e. forward edges upwardly, as will be explained hereinafter in greater detail.

Generally, the illustrated vertical system 18 of the blind 10 includes a pair of spaced apart forward vertical members 20 recessed within the slats 16 and a pair of spaced apart rearward vertical members 22 at the rear of the slats 16. The members 20 and 22 depend from the head-rail 12 and support and tilt the slats 16 from a downwardly fully sealed position (FIG. 1) which hides the vertical system 18 from view (in this embodiment from an interior view) to an upwardly tilted position (FIG. 2) and to an intermediate, horizontal open for viewing position (FIG. 3).

Figure 8:
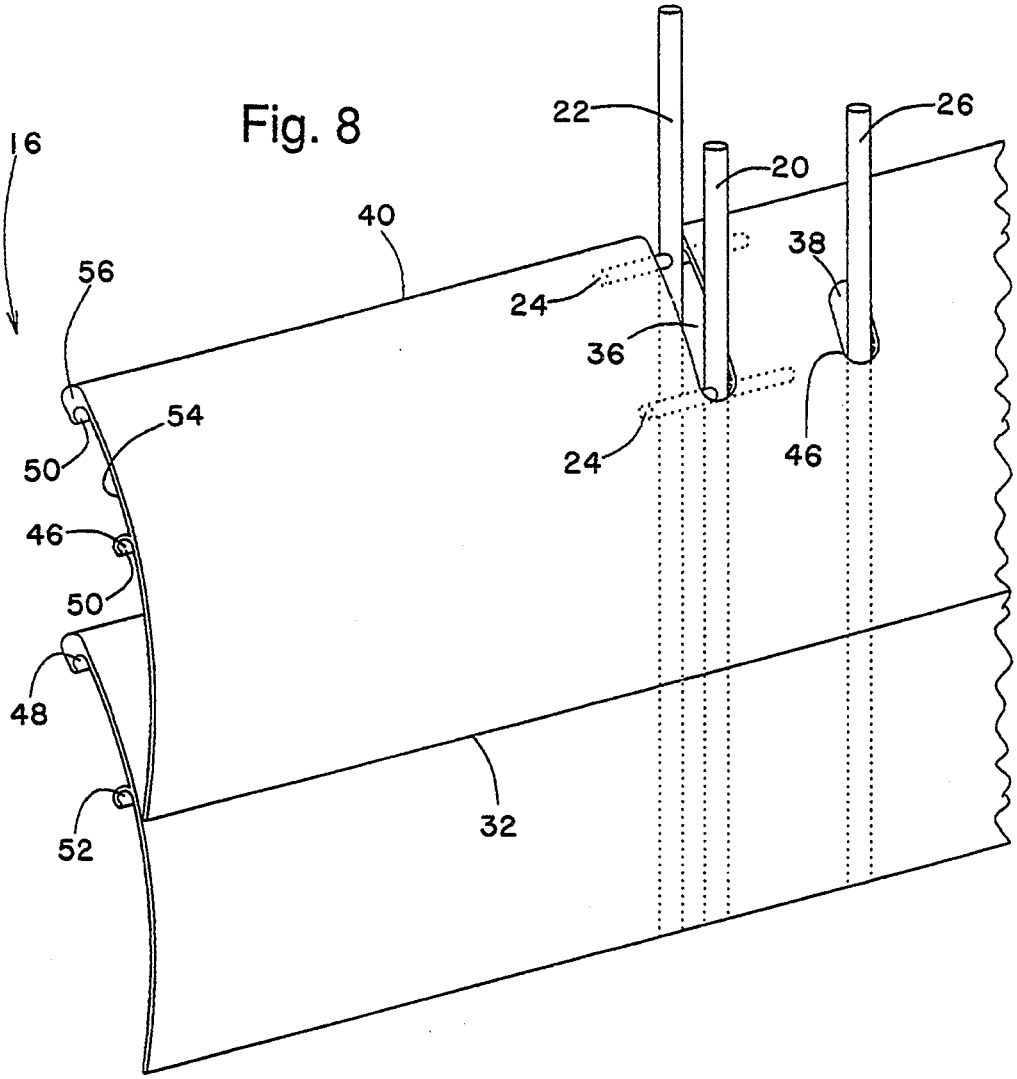
FIG. 8 is a perspective view of a detail view of the preferred embodiment of the invention showing the slats in the fully titled downward or sealed position.
Figure 9:
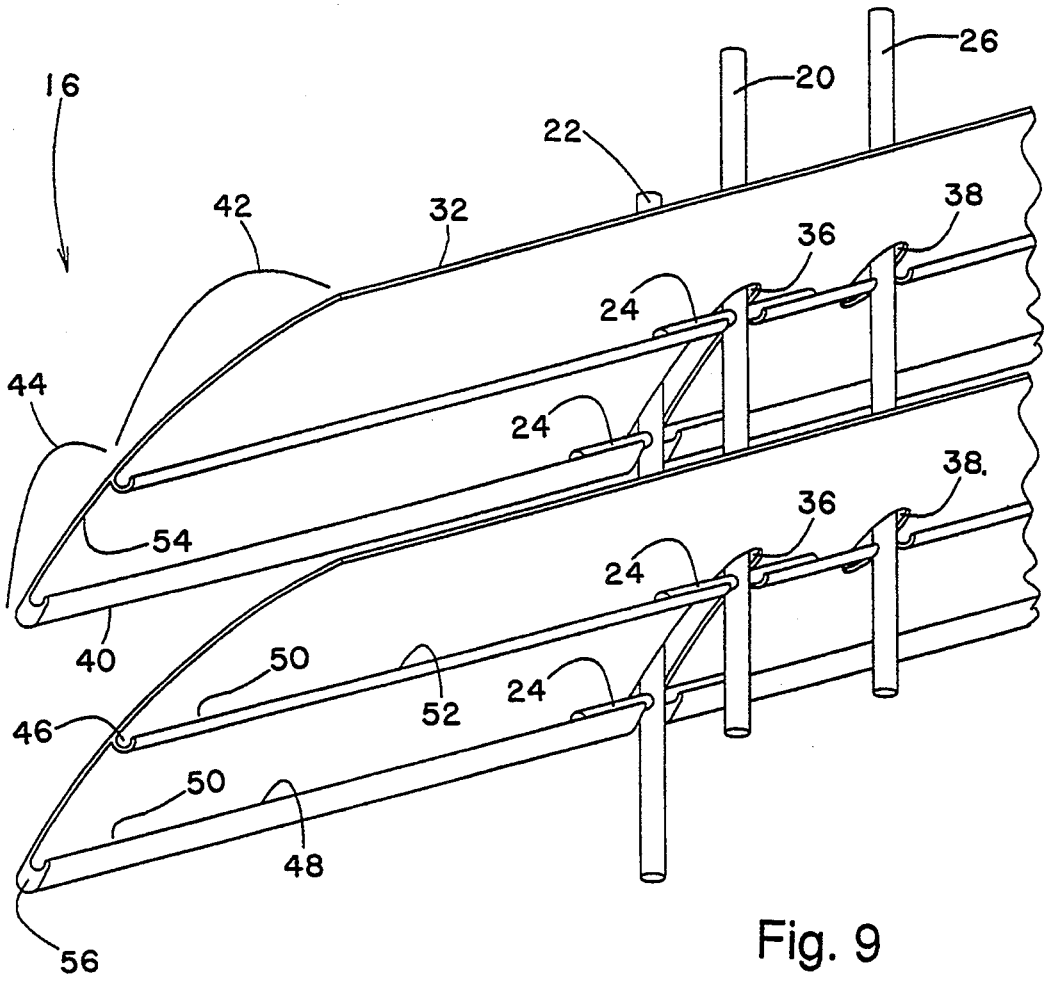
FIG. 9 is a perspective view of a detail view of the preferred embodiment of the invention showing the slats in the partially tilted upward position.

As illustrated in FIGS. 8 and 9 the members 20 and 22 in this embodiment include rods or pins 24 which interact with the slats 16 to support and tilt the slats 16 as already generally described and as will be described in greater detail hereinafter.

Figure 2:
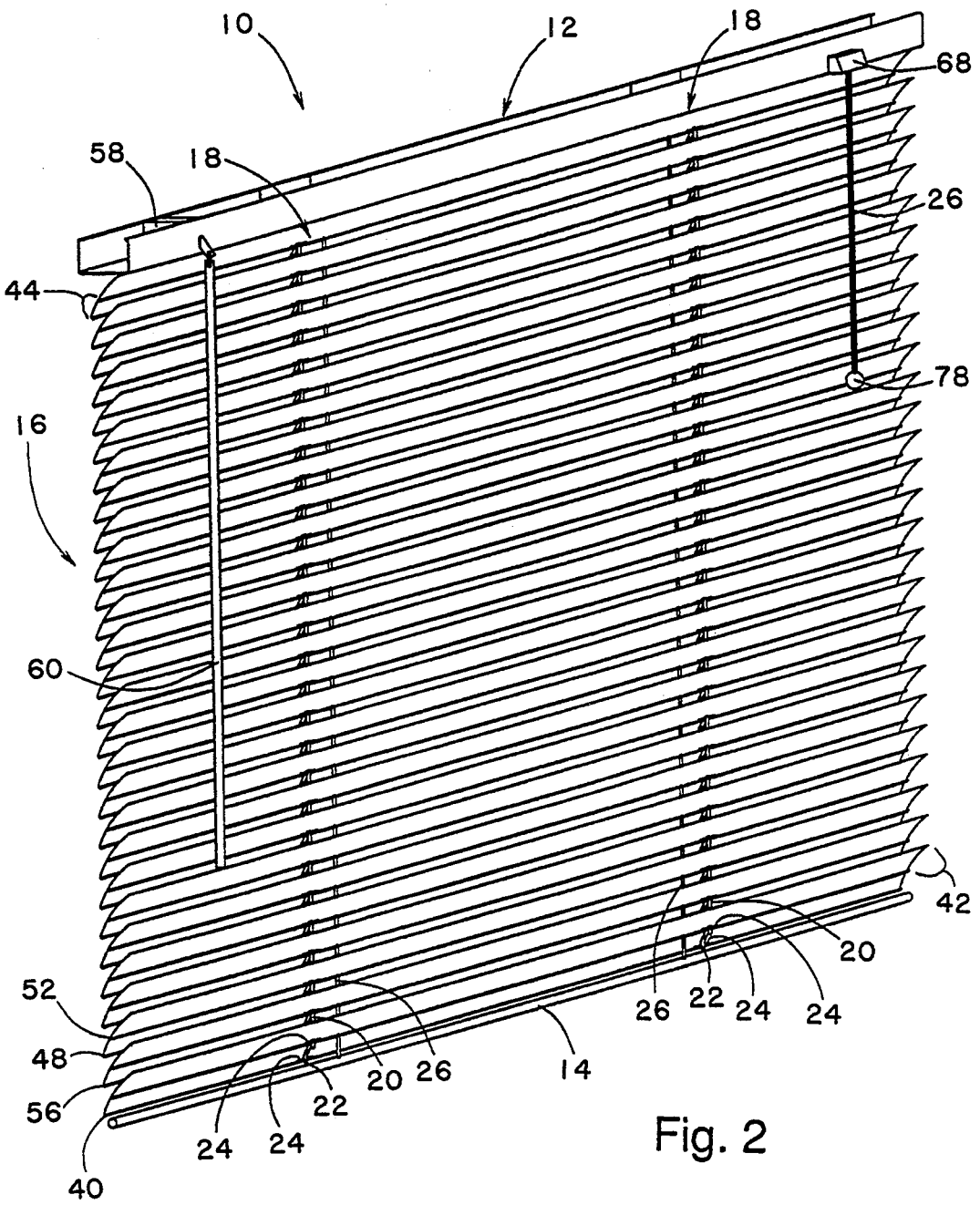
FIG. 2 is a perspective view of a general view of the preferred embodiment of the invention in a fully lowered position with the slats in the fully tilted upwardly position.
Figure 3:
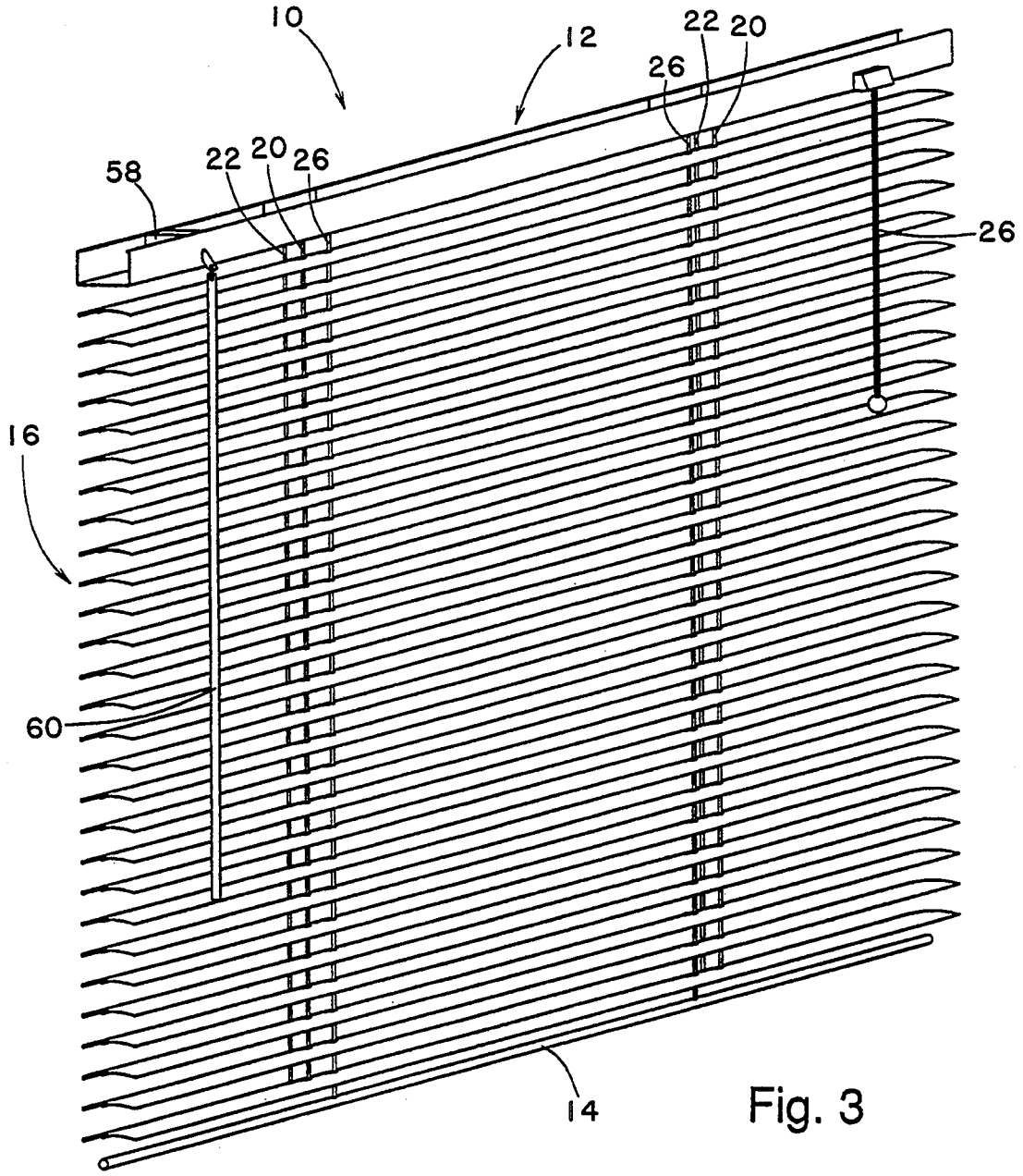
FIG. 3 is a perspective view of a general view of the preferred embodiment of the invention in a fully lowered position with the slats in the full open-to-view position.

The vertical system 18 of the present invention also includes a pair of spaced apart vertical lift-cords 26 which lift-cords 26 extend through the slats 16 and are connected to the bottom-rail 14 (See FIG. 2). The lift cords 26 raise and lower the slats 16 and bottom-rail 14 independent of the tilted position of the slats 16.

Figure 4:
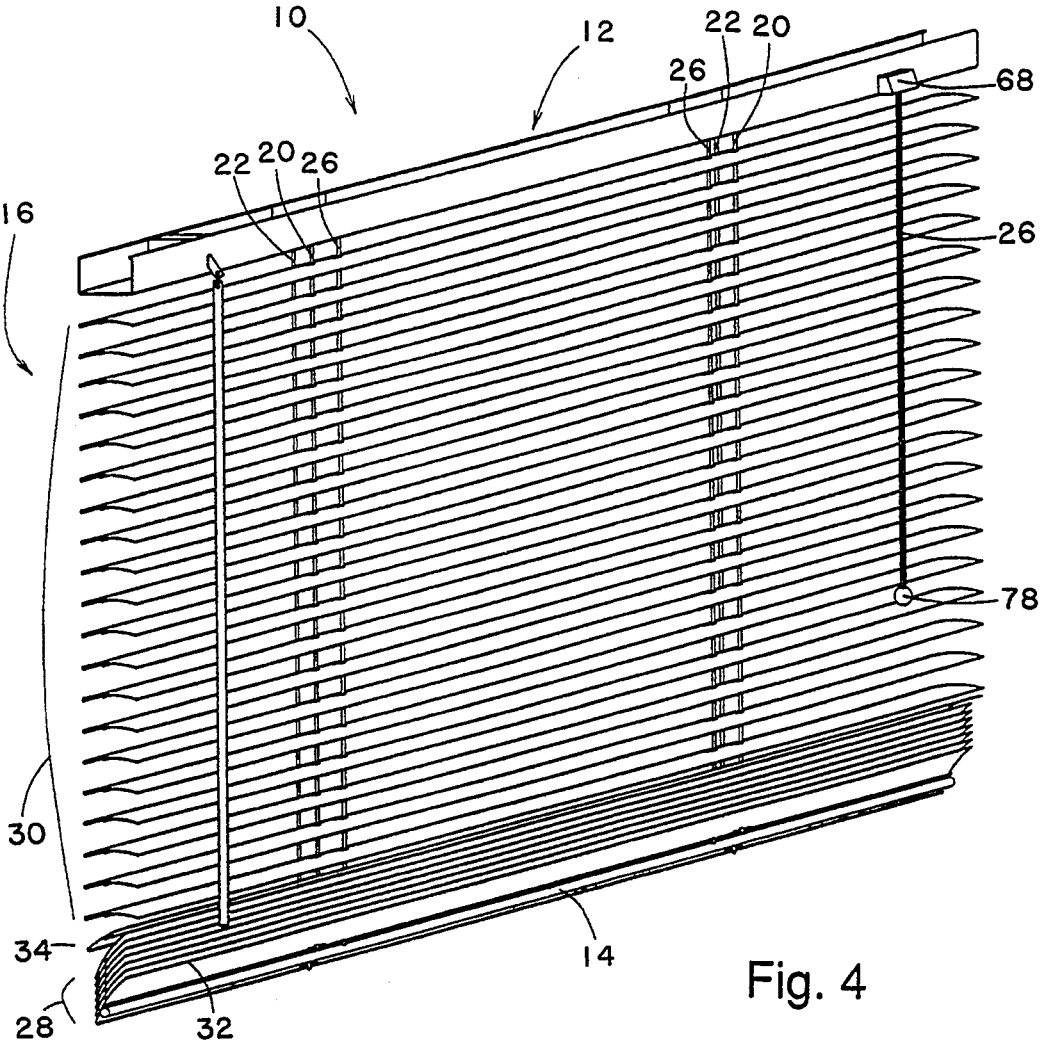
FIG. 4 is a perspective view of a general view of the preferred embodiment of the invention in a partially raised position wit the slats in the full open-to-view position.

In FIG. 4, for example, the blind 10 has been independently and partially raised by the lift-cords 26 while the vertical members 20 and 22 have independently moved the slats 16 to the open for viewing position. In this view it can be seen that the lifted or compressed slats in the lower portion 28 of the blind 10 are at a different angle than are the spaced slats in the upper portion 30 of the blind 10. Because the slats 16 are weighted to bias their forward edges 32 upwardly when not forced to assume another angle by the vertical tilt members 20 and 22, these lifted slats 28 will assume the forward edge-up orientation. Both the forward and rearward vertical lift members 20 and 22 have been compressed or gathered between or behind each of the lifted slats 28 and therefore have no more effect on the lifted slats 28 orientation. These lifted slats 28 are being supported by the bottom-rail 14 which in turn is being supported only by the two or more partially raised lift-cords 26. The entire weight of the lifted slats 28 is therefore on the lift-cords 26 and not on the vertical tilt members 20 and 22. The remainder of the spaced slats 30 have their angles unchanged as they are still spaced, supported and caused to be tilted by the vertical tilt members 20 and 22. The spaced slat's 30 weight is still on the vertical tilt members 20 and 22.

Between the gathered or lifted slats 28 that are supported by the lift-cords 26, and the full open-to-view and spaced slats 30 that are supported by the vertical tilt members 20 and 22, there are one or more slats that have their angles in sequential transition. These transition slats 34 will always be at angles between the angles of the other two collections of slats 28 and 30 and will transcend from the angle of the lower portion collected slats 30 to the angle of the upper portion dispersed slats 30.

Figure 5:
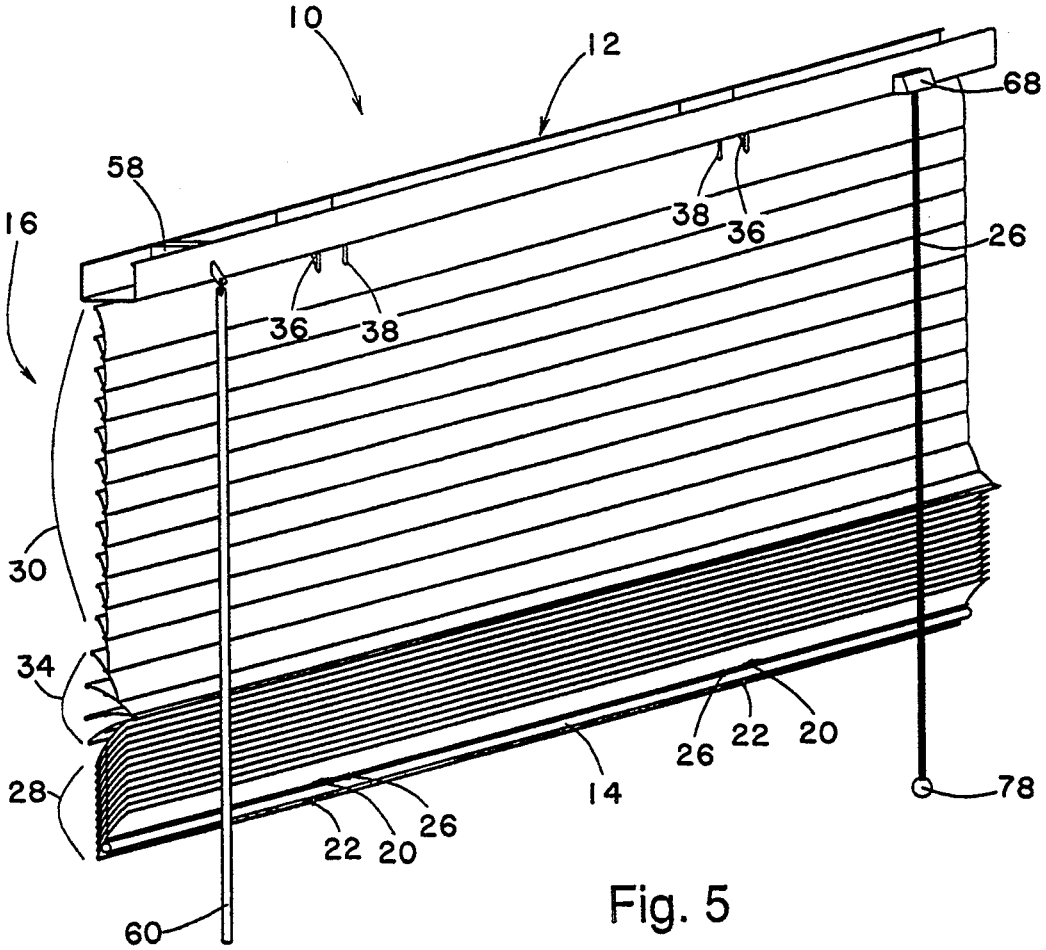
FIG. 5 is a perspective view of a general view of the preferred embodiment of the invention in a partially raised position with the slats in the fully tilted downwardly or sealed position.

Another example of the independent position of the slats 16 is shown in FIG. 5, wherein the blind 10 has been independently and partially raised by the lift-cords 26 while the vertical members 20 and 22 have independently moved the slats 16 to their fully closed downwardly sealed position. In this view the compressed or gathered slats 28 resting on the bottom-rail 14 are subject to the same angle orientation change as occurred in FIG. 4 and for the same reasons. This view shows the upper slats 30 in the fully tilted downwardly position or the fully sealed position and it can be seen that the room-darkening quality of having the slats 16 seal against one another and hide the cords 20, 22 and 26 and openings 36 and 38 is unchanged except for that portion of the window opening (not shown) below the raised slats 28 where obviously light and view will be admitted to the interior environment.

As in FIG. 4, there are one or more slats in transition 34 between the slats in the upper portion 30 which are supported by the vertical tilt members 20 and 22 and the slats in the lower portion 28 which are supported by the lift-cords 26. The slat or slats in this transition zone 34 will assume angles between the angles of the slats in the upper 30 and lower 28 portions of the blind.

In this embodiment of the invention, moreover, the bottom-rail 14 is of the non-tilting type, wherein only the lift-cords 26 are connected to the rail 14 (see FIG. 3). In operation, the bottom-rail 14 will only be raised or lowered by the cords 26 without tilting or rotation of the bottom-rail 14.

Referring now to FIGS. 8 and 9, the illustrative slats 16 preferably comprise plastic and can be formed by extrusion. The extruded slats 16 include forward 32 and rearward 40 edges, generally have a C-cross sectional shape with a forward cantilevered portion 42 and a weighted rear portion 44 provided by the added bulk of plastic at the rear edge 40. The weighted rear portion 44 more than offsets the weight of the longer cantilevered portion 42 of the slats 16 that lies forward of the pivot point 46 which is the same point occupied by the forward vertical support member 20.

It can be seen in FIGS. 8 and 9 that the pins or rods 24 on the tilt member 22 and on the support member 20 are equally spaced apart at a distance similar to conventional ladder spacing and are operatively connected to the slats 16 by entering an opening or slot 36 in the rear edge 40 of the slats 16 and snap-fitting the pins or rods 24 into the openings 50 in each of the two channels 48 and 52. The pins or rods 24 on the tilt members 22 snap-fit into the rearward channels 48 and the identically spaced pins or rods 24 on the support members 20 snap-fit into the forward channels 52 to space each slat apart from one another similarly to the slat spacing of a conventional Venetian blind. The pins or rods 24 can be precision injection molded onto a pair of woven or braided vertical members 20 and 22 in a sequentially stepped manner where, for example, a dozen or so plastic pins 24 might be molded onto the vertical members 20 and 22 at once, then the vertical members 20 and 22 are indexed to mold the next dozen or so pins 24 onto them such that the spacing between each set of pins 24 is identical to the spacing between each pin 24, resulting in continuous vertical members 20 and 22 with all pins 24 equally spaced. The pins or rods 24 may also be made of metals such as aluminum, steel, or brass, and can be inserted in a precision indexed manner and pass completely through the vertical members 20 and 22 and be capped, crimped, riveted or suitably anchored into place so that both halves of each pin 24 protrude from the vertical members 20 and 22 with all pins equally spaced. The spacing for pin 24 locations on both vertical members 20 and 22 is identical such that the space between and angle of the supported slats 16 will be identical.

It can best be seen in FIGS. 8 and 9 that a slot 36 that has been milled, machined, die cut or blanked into the rearward portion 44 of the slats 16 to accommodate the vertical members 20 and 22. This slot 36 passes through both channels 48 and 52 and allows the vertical previously described members 20 and 22 and their pins or rods 24 to be inserted or removed from the rear edges 40 of the slats 16. The slots 36 are somewhat wider than either of the vertical member's 20 and 22 to provide a clearance against the vertical member's 20 and 22 chaffing or rubbing the sides of the slots 36 while the slot's 36 length provides necessary open space for clearance of the vertical members 20 and 22 when the slats 16 tilt upwardly or downwardly while the vertical members 20 and 22 remain vertical.

The slats 16 in FIGS. 8 and 9 further show openings 38 to accommodate the vertical lift-cords 26. The location of the lift-cords 26 are directly adjacent to and in alignment with the forward vertical member 20 or the pivot point 46 of the slats 16. This causes the slats 16 to be supported when lifted by the lift-cords 26 and bottom-rail 14 at the pivot point 46 which is forward of the slat's 16 center of balance 54 and assures that the lifted or sequentially gathered slats 28 will take a forward-edge-up orientation. The openings 38 in the slats 16 to accommodate the lift-cords 26 are slightly wider than the lift-cords 26 for clearance and are substantially longer than they are wide to allow the slats 16 to tilt while the lift-cords 26 remain vertical and still not have the ends of the openings 28 come into contact with the vertical lift-cords 26 which would restrict the slats 16 ability to freely rotate or tilt in either direction to the necessary angles.

With the slats 16 tilted upwardly as illustrated in FIGS. 2 and 9, the two integrally molded channels 48 and 52, a forward channel 52 and a rearward channel 48, on the bottoms of the extruded plastics slats 16 can be seen from the interior of the environment. These two channels 48 and 52 serve to capture, in a press-fit manner, the small pins or rods 24 that are equally spaced and operatively connected to the forward vertical tilt member 20 and rearward vertical tilt member 22, thereby spacing, supporting and providing tilting means for the slats 16. At the rear most edges 40 of the slats 16 there is a heavy section 56 of integrally extruded plastics material adjacent to and contiguous to the rearward channel 48 to cause the rearward portion 44 of the slats 16 rearward of the forward vertical tilt member 20 to be slightly heavier than the forward portion 42 of the slats 16 forward of the forward vertical tilt member 20 thereby causing the slats 16 to take a forward-edge-up orientation when not urged to take another orientation by the movement of the vertical tilt members 20 and 22.

Figure 6:
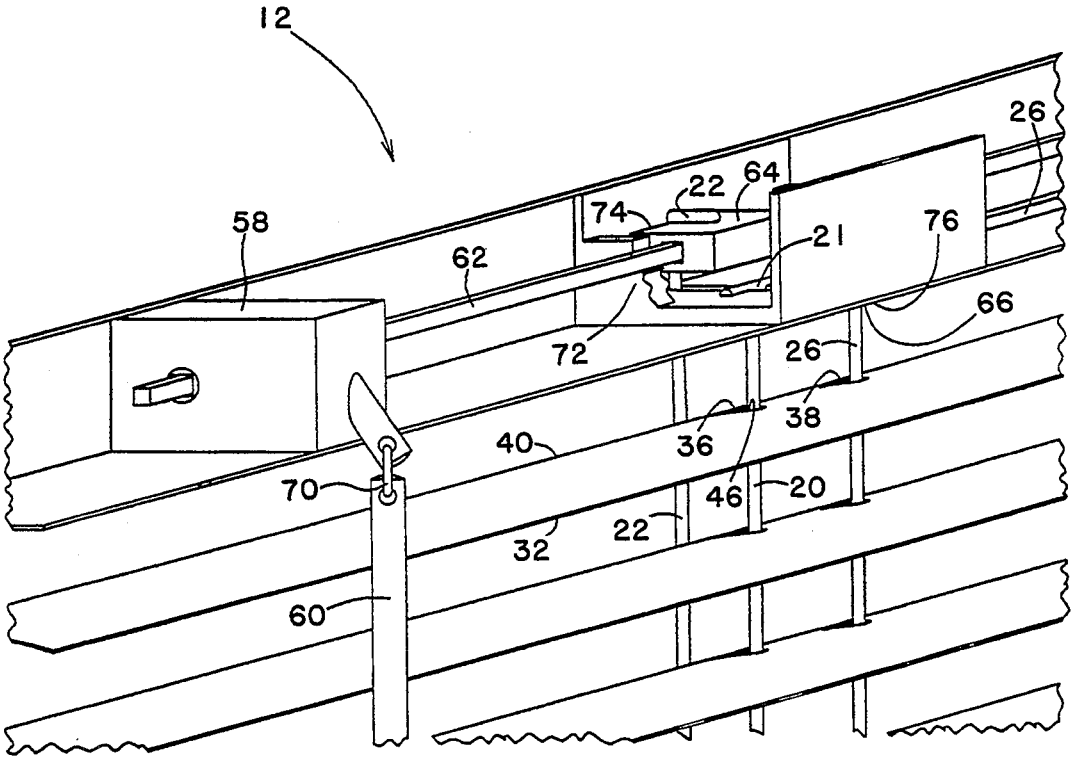
FIG. 6 is a perspective view of an upper left-side detail view of the preferred embodiment of the invention showing a cut-away of the head-rail.

FIG. 6 shows perspective view of an upper left-side detail view of a preferred embodiment of the invention with a cut-away of the head-rail 12 and partial cut-away of the cradle 72. Typically the head-rail 12 (FIGS. 1–3) can be mounted to the top of the window frame via two mounting brackets (not shown), each of which is secured by one or more screws to the top, innersides or front of the window frame or adjacent wall (not shown). The tilt-rod 62 and the rotationally attached tilt-drum or tilt-bar 64 within the head-rail 12 rests in a cradle 72 that allows rotational movement but supports the drum or bar 64 and the tilt-rod 62 from sagging or dropping as a result of the weight of the flexibly suspended slats 16 hanging therefrom.

In the cut-away of the head-rail 12 one can see the typical high-ratio worm-gear box 58 which is driven through a universal joint 70 by a manually operated tilt-wand 60 and through which a typically square or multi-sided tilt-rod 62 passes. The tilt-rod 62 also passes through and causes to be rotated two or more tilt-drums or tilt-bars 64. One or both of the flexibly suspended vertical tilt members 20 and 22 may be operatively connected to the tilt-drums or tilt-bars 64 and are caused to be raised and/or lowered by the rotation of the drum or bar 64.

In this preferred embodiment of the invention the forward vertical tilt member 20 has a suitable means of termination 21 inside the head-rail 12 that co-act with the cradle 72 and the head-rail 12 to support the forward vertical member 20 and the slats 12 and prevent the forward vertical member 20 from passing through the opening in the cradle 72 and the opening in the head-rail 66 under the collective weight of the slats and bottom-rail 14 and is therefore stationary, and will not be caused to move upward or downward. As a result, the forward vertical tilt member 20 will be hereafter referred to as the forward support member 20 or simply as the support member 20 as it still supports and spaces the slats 16, but in tilting, is stationary and acts only as the slats 16 pivot point 46 for the rearward vertical tilt member 22 to operate about when raised and/or lowered.

When a common tilt drum (not shown) of a generally constant diameter is employed, the distance between the vertically moving tilt member 22 and the stationary support member 20 remain generally constant as the drum rotates and the tilt member 22 is raised and/or lowered. As can be best seen in FIG. 6 of the preferred embodiment, when a tilt bar 64 is employed for slat 16 rotation, the rotating tilt bar 64 will cause the slats 16 to rotate about their pivot point 46 when the tilt member 22 is raised and/or lowered and in doing so, will create linear movement of the rearward edge 40 of the slats 16 and the tilt member 22 toward or away from the stationary support member 20 as the tilt member 22 rides around the rearward edge 74 of the tilt bar 64. During the sealing process this linear movement of the tilt member 22 toward the support member 20 will result in a reduction of the distance between the tilt member 22 and the support member 20 that will improve slat closure, particularly in the uppermost slats by allowing the two vertical members 20 and 22 to come closer to or contact each other.

As can best be seen in FIG. 6, the lift-cord 26, which is attached to the bottom-rail 14 and passes through aligned openings in each slat 38, passes through an opening 66 in the bottom of the head-rail 12 and an aligned opening 76 in the bottom of the cradle 72, whereupon the lift-cord 26 turns an approximately 90 degree corner and travels through the head-rail 12, through the next cradle 72 where it is joined by an additional lift-cord 26, and continues this sequence until the two or more lift-cords 26 exit the head-rail 12 through a cord-lock 68 (see FIGS. 1–5), whereupon they fall free to a terminal end that is usually terminated in a tassel, knob 78 (see FIGS. 2 and 4) that serves to keep the lift-cords 26 lengths in proper alignment.

Figure 7:
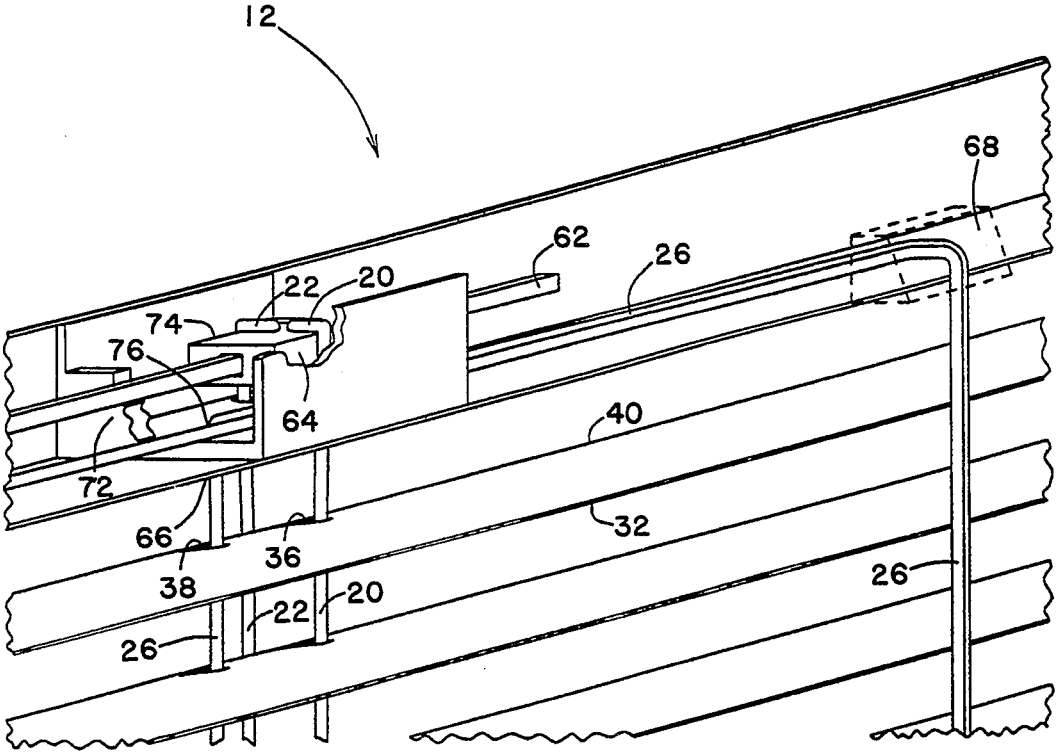
FIG. 7 is a perspective view of an upper right-side detail view of the preferred embodiment of the invention showing a cut-away of the head-rail.

FIG. 7 shows a perspective view of an upper right-side detail view of the invention showing a cut-away of the head-rail 12 and partial cut-away of the cradle 72. In this illustration a second embodiment of attaching the vertical system 18 to the head-rail 12 is shown. The tilt bar 64 has both the tilt member 22 and the support member 20 attached to the tilt bar's 64 uppermost point or directly above the tilt rod 62 thereby simultaneously lifting and/or lowering both the tilt member 22 and support member 20 in a conventional manner causing the slats to rotate except that the member 22 and support member 20 are allowed to come into closer proximity one to the other. Pulling downwardly on the collective lift-cords 26 will correspondingly lift the bottom-rail 14 of the blind 10 in a one-to-one ratio and in a parallel and level manner.

Figure 10:
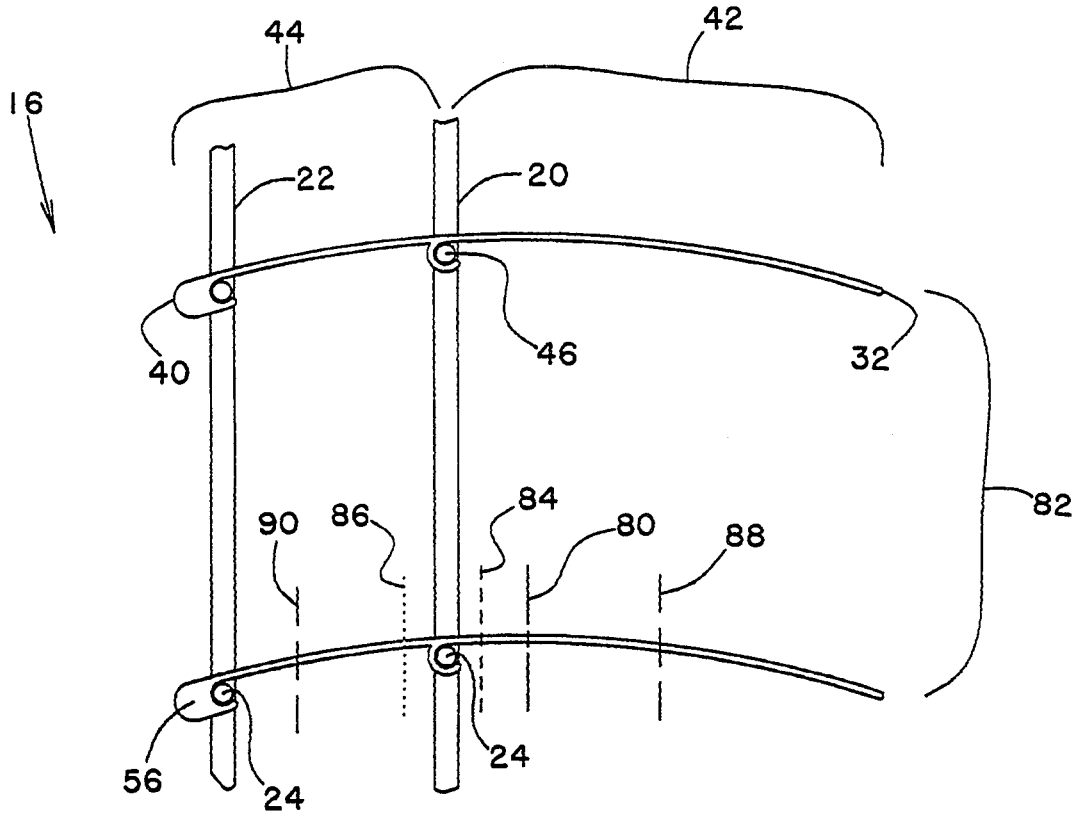
FIG. 10 is an end view of a detail view of the preferred embodiment of the invention showing the slats in the full open-to-view position with dimensional ratios and weight formulas.

With further respect to the slats 16 of the invention, FIG. 10 shows a detailed view of a preferred embodiment of the slat 16 in the full open-to-view position with dimensional ratios. The forward edges 32 to rearward edges 40 dimensions of the slat 16 in the preferred embodiment is 1.5 X or 1.5 inches and the slats 16 center-of-dimension 80 is therefore 0.75 X or 0.75 inches. The vertical centerline to centerline spacing 82 between the slats 16 is 0.85 X or 0.85 inches which is the same as 21.5 mm. This slat 16 spacing 82 is identical to the common spacing of conventional one inch slat Venetian blinds where the rungs of a conventional ladder are spaced at 21.5 mm which causes the one inch slats when fully tilted to have a slat overlap of approximately 0.15 inches or 15% and an exposed portion of each slat of 0.85 inches or 85%. It can be seen in FIG. 8 that when this 0.85 X or 0.85 inch slat spacing dimension 82 is measured horizontally or translated into the slat's overlap point 84, this point is rearward of the slat's center-of-dimension 80 of 0.75 X. The forward edge of the vertical support member 20 is located at 0.90 X or 0.90 inches from the forward edges 32 of the slats 16. This assures that the forward most openings 36 or 38 of the slats 16 is rearward of the slat's overlap point 84 such that when the slats 16 tilt to their full downward position or their fully sealed position, the uninterrupted portion of the slats 16 will hide all of the cords 20, 22 and 26 and respective openings 36 and 38 in the slat 16 immediately below. It is the purpose of the preferred embodiment of the present invention, therefore, to generally conform to the current standard 1 inch Venetian blind slat spacing and slat exposure when sealed. Furthermore, the exposed portion of the slats 16 that hides the vertical system 18 facilitates ease of its cleaning.

In the preferred embodiment of the invention, as best seen in FIG. 10, the slat's 16 width from its rearward edge 40 to its forward edge 32 is one and one-half inches; the slat 16 has conventionally crowned cross-section to provide necessary longitudinal rigidity to the material; the slat's 16 wall thickness is as minimal as possible preferably in the range of 0.010~0.020 inches to reduce material usage and subsequent weight of the slat 16; the vertical slat spacing 82 is similar to today's conventional one inch wide slat spacing of about 0.85 X or 0.85 inches or approximately 53/64ths of an inch or 21.5 millimeters; this dimension is the same as the uninterrupted forward portion 42 of the slats 16 except the forward portion 42 of the slats 16 have some additional minimum dimension added to provide slat overlap point 84 tolerances and support member 20 stretch such that each slat 16 is assured of completely obscuring the support member 20 and its operational engagement means.

It can also be seen in FIG. 10 shows that weight 56 has been added to the rearward portion 44 of the slats 16 in the form of a concentrated mass of the extruded plastics material 56. This addition of weight 56 in this location results in the slat's 16 center-of-dimension 80 remaining unchanged, while the slat's 16 center-of-balance 86 has been caused to be moved rearward of the support member 20 or the slat's 16 pivot points 46. The slat's 16 center-of-balance 86 being rearward of the slat's 16 support member 20 and point of operational engagement with the slats 16, results in the slat's 16 now having a gravitational bias for their forward edges 32 to rise and their rearward edges 40 to fall with the point of operational engagement serving as the point of rotation or the pivot point 46. The amount of weight 56 added and the location of its mass will determine the precise location of the slat's 16 center-of-balance 86.

Figure 13:
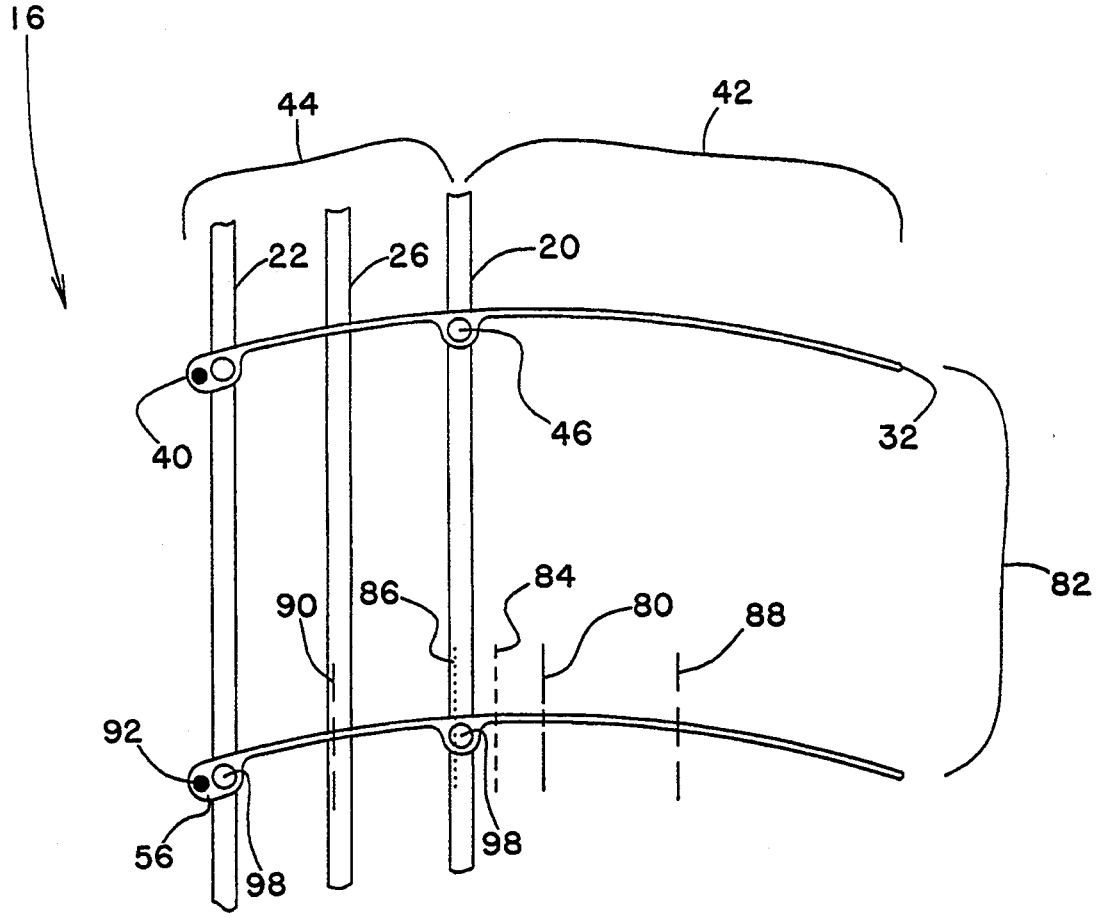
FIG. 13 is an end view of a detail view of the blind of FIG. 11 showing the slats in the full open-to-view position with dimensional ratios and weight formulas.

The slats 16 of this preferred and of other embodiments (see, FIGS. 8, 11, 14, 15, 16 and 17) of the invention include a forward edge 32, a rearward edge 40, and a pivot point 46 located rearward of the center-of-dimension 80 and between the two edges 32 and 40. In accordance with the invention, the slats 16 when viewed from their ends in an open-to-view or generally horizontal position (as best seen in FIGS. 10 and 13) are crowned or otherwise so configured such that forward edge 32 lies below a horizontal plane (not shown) passing through pivot point 46, and rearward edge 40 lies at or below a horizontal plane passing through pivot point 46.

Another embodiment of the invention which can also be seen in FIG. 10 may use, for example, a conventional 1" slat 16, measured from the slat's 16 forward edge 32 to its rearward edge 40. In this dimensionally smaller embodiment, the slat's 16 center-of-dimension 80 is 0.5 inches and the vertical centerline to centerline spacing 82 between slats 16 is 0.57 inches or 14.4 mm. This dimension, when measured horizontally, relates to the slat's 16 overlap point 84 which is also 0.57 inches and therefore falls rearward of the slat's 16 center-of-dimension 80 which is 0.5 inches from the forward edge 32.

The forward edge of the vertical support member 32 of the slat 16 is located 0.60 inches from the forward edge 32 of the slat 16. Since the slat's 16 overlap point 84 at 0.57 inches from the forward edge 32 is forward of all other described points (except the center-of-dimension 80 at 0.5 inches), the vertical system 18 and the openings 36 and 38 will be obscured from interior view by the interrupted cantilevered portion of the slat 16 forward of the slat's 16 overlap point 84 when the slats are tilted to their sealed position as the vertical system 18 and openings 36 and 38 all lie rearward of the slat's 16 overlap point 84 at 0.57 inches from the forward edge 32.

The present invention also includes a formula for predicting and calculating how much and where additional weight will be required to be added to the shorter rearward portion 44 of each individual slat 16 to have the mass of the shorter rearward portion 44 equal or exceed the mass of the longer forward portion 42 and therefore have each individual slat 16 rotate to and/or beyond the open-to-view position. Both the forward portion 42 and the rearward portion 44 of each slat 16 have a known existing mass resulting from that portion's existing cross-sectional material and the location of the portion's center-of-balance 86, which naturally, is the same location as that portion's center-of-mass. The heavier existing mass of the forward portion 42 is subtracted from the lighter existing mass of the rearward portion 44 to determine how much additional weight will be required and where it should be added to the rearward portion 44 to cause the entire individual slat 16 to behave as desired. The formula is based upon the law of static mechanics of forces in equilibrium which states that the force of the effective load on one side multiplied by its effective distance from a fulcrum is equal to the force of the effective load on the other side multiplied by its effective distance from the same fulcrum and will heretofore be explained in greater detail in reference to the illustrative embodiments in FIG. 10 and 13.

It can further be seen in FIG. 10 that slats 16 with the necessary weight 56 included proximate the rear edges 40 are continuous extruded elements integral within the slat 16. Other counter-weights 56 may be achieved by adding separate continuous elements or segments of separate elements to each slat as will heretofore be described in other embodiments and illustrated in greater detail.

Furthermore, a slat 16 of the invention can have the necessary weights 56 added proximate the rear edges 40 in a manner suspended from the slat's 16 rear edges 40. In that case, the necessary added weights 56 act upon the rear most portions 44 of the slats 16 in the same way they would if they were inflexibly attached to the rear most portions 44 of the slats 16. The necessary required added weights 56 may be hung from the slats 16 and will occupy only the spaces available between the slats 16. The necessary weights 56 may or may not be integral with the tilt members 20.

Additionally, combinations of the several means of adding weights 56 may be employed. For example, some additional weights 56 can be continuously integral proximate the rear edges 40 of the slats 16 and additional segmented weights 56 can be hung or suspended from the slats 16 or integrated with the tilt members 22 such that the combination of the several sources of additional weights 56 are sufficient to cause the desired forward edges-up-bias.

Figure 11:
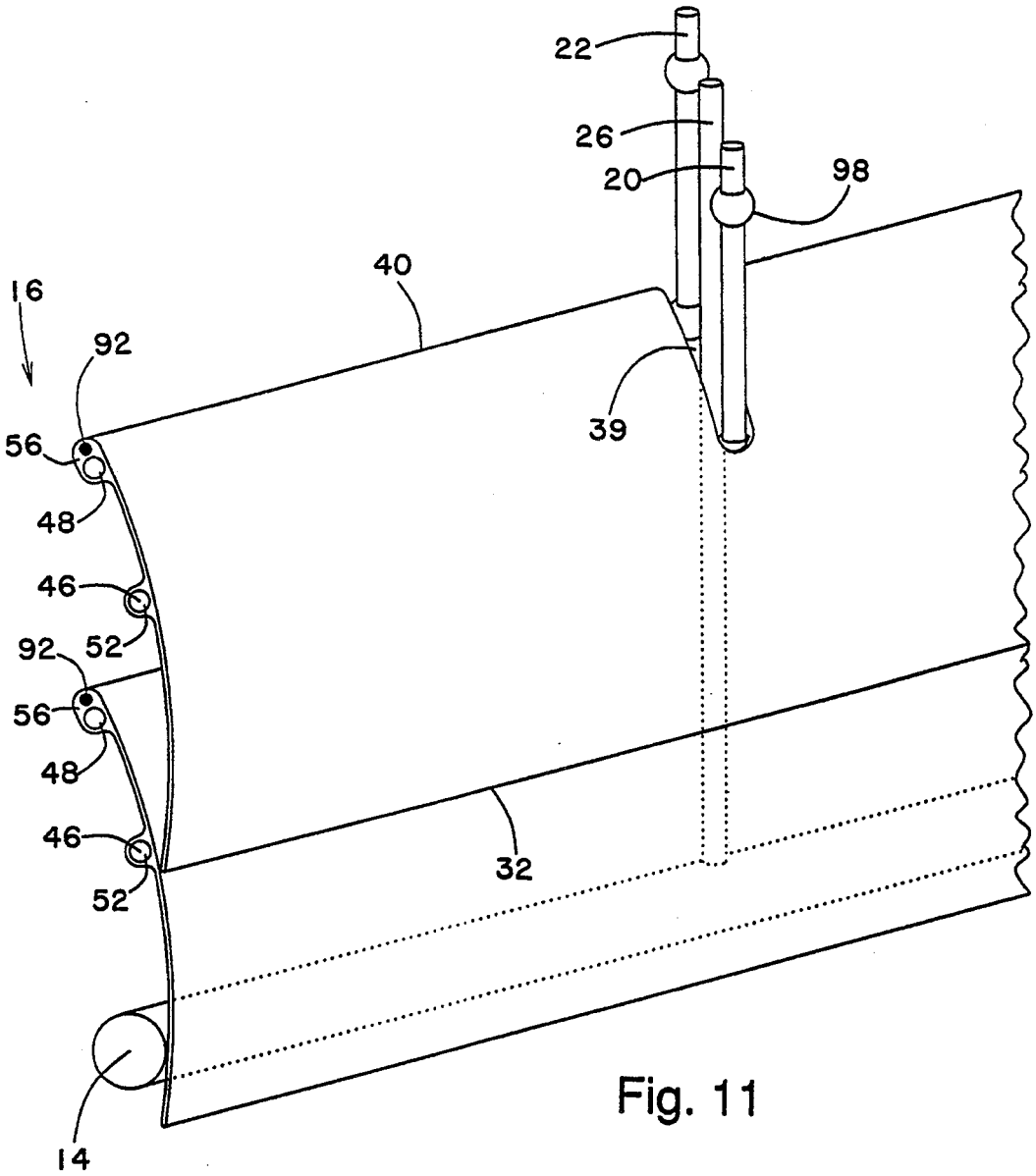
FIG. 11 is a perspective view of a detail view of another embodiment of the invention showing the slats in the fully tilted downward or sealed position.
Figure 12:
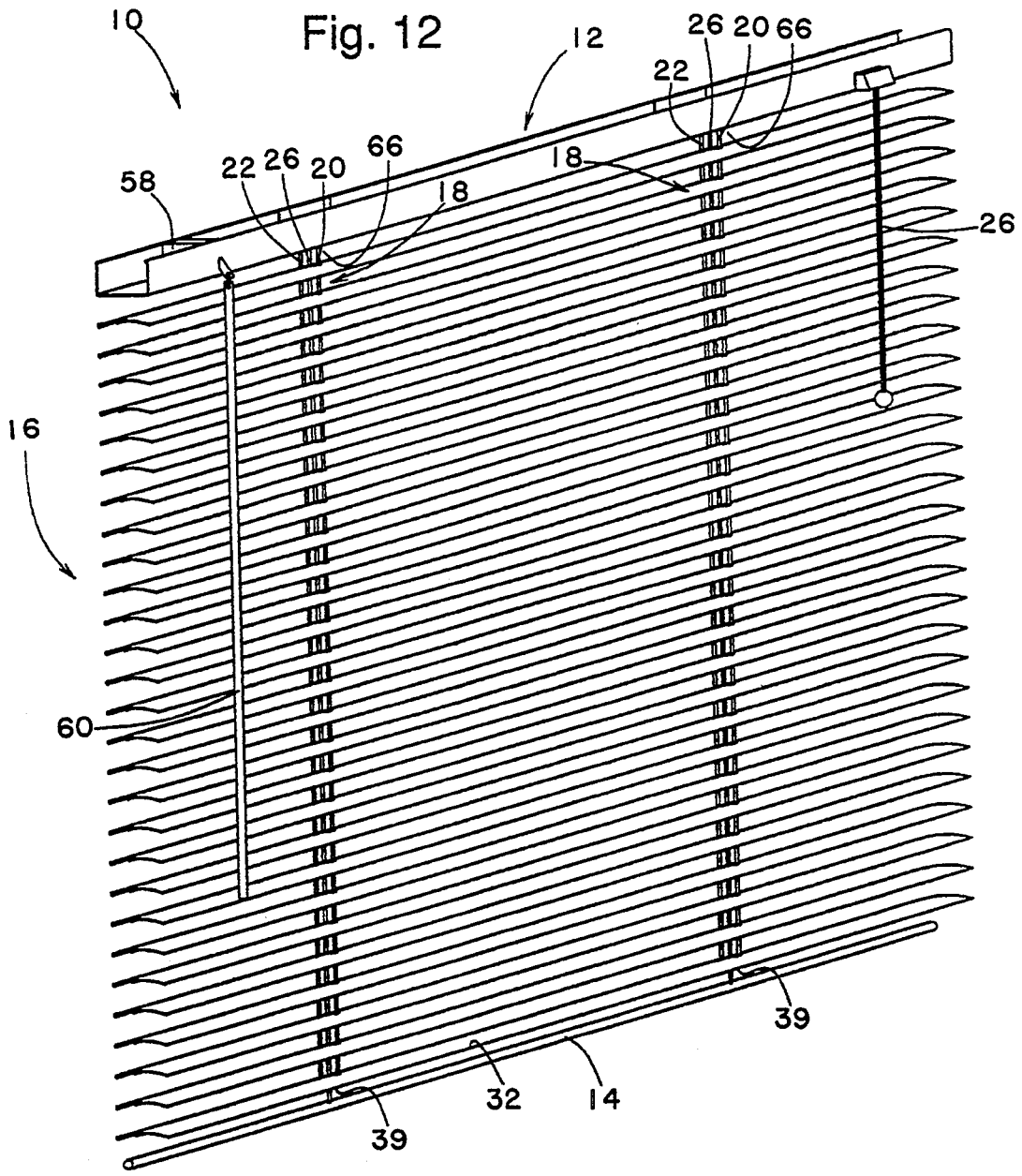
FIG. 12 is a perspective view of a general view of the blind of FIG. 11 in a fully lowered position with the slats in the full open-to-view position.

Referring now to FIGS. 11–13, there is shown another embodiment of the present invention. As illustrated in FIG. 11, the slats 16 are in the fully tilted downward or sealed position. The bottom-rail 14 is of the non-tilting type and is supported solely by the lift-cords 26 and does not rotate or tilt with the slats 16.

The slats 16 illustrated are preferably of plastics material and are shown as being co-extruded with dissimilar material 92 imbedded in the heavy section of material 56 proximate the slat's 16 rear edge 40. This dissimilar coextruded material 92 is more dense or heavier than is the remainder of the material in the slat 16. This area of coextruded material acts as an additional counterbalance weight 56 and can be of any cross-sectional shape appropriate to fit within or to occupy the entire heavy section 56.

Additionally, the dissimilar material 92 need not be co-extruded, but can be inserted into a hollow extruded opening in the heavy section 56 of slat 16 in which case the dissimilar material 92 may be continuous or may be in segments.

Also shown in FIG. 11 are the support member 20, the lift-cord 26 and the tilt member 22 all in forward to rearward alignment within one combined opening 38 for the vertical system 18. The support member 20 and tilt member 22 have rigid nodes 98 equally spaced that serve to rotatably engage the channels 48 and 52 on the undersides of the slats 16 such that the slats 16 are caused to be spaced, supported and tilted. The lift-cords 26 act independently of the vertical members 20 and 22.

The full blind 10 of this embodiment is illustrated in FIG. 12 and shows the blind 10 in its full open-to-view position with a non-rotating bottom-rail 14 attached.

Each 1.5 inch wide slat 16 has only enough counter-weight 56 to achieve the depicted open-to-view position, the maximum upward disposition of the forward edge 32 of the slats 16. By adding a greater amount of counter-weight 56 to a 1.5 inch slat 16 with a similar profile made of identical material, the forward edge 32 will take a greater upward disposition (see, FIG. 2) as represented in showing the slats 16 of the preferred embodiment of the invention.

The law of static mechanics of forces in equilibrium applies to all embodiments of the present invention but can best be understood when first applied to FIG. 13. The law states that force of (Mass 1 or M1) the effective load 90 of slat 16 acting on (Weight 1 or W1) the weight of the rearward portion 44 of slat 16 multiplied by (Distance 1 or D1) its effective distance from the fulcrum or pivot point 46 must equal the force of (Mass 2 or M2) the effective load 88 of the slat 16 acting on (Weight 2 or W2) the weight of the forward portion 42 of the slat 16 multiplied by (Distance 2 or D2) its effective distance from the fulcrum or pivot point 46, to enable the slat 16 to be in balance and take the full open-to-view or generally horizontal position when the tilt member 22 is relaxed and fully lowered.

Briefly stated in terms of a formula, in the illustrative embodiment depicted in FIG. 13 where D1 and D2 are dissimilar, $W1 \times D1 = W2 \times D2$, or $M1 = M2$.

When the weight of the operatively connected tilt member 22 is added to the portion 44 of the slat behind the support member 20, the effective rearward load 90 increases slightly and effectively moves rearward slightly to bring the center of balance 86 of the slat 16 just behind the pivot point 46 and thereby allow the forward edge 32 of the slat 16 to take a position just slightly upward of the full open-to-view position. The combination of weight elements depicted in this second embodiment represents the most counter-weight efficient embodiment of the invention with an 1.5 inch wide slat 16 that will achieve the full open-to-view position with complete room darkening and full privacy when the blind 10 is fully lowered with 0.85 inches of sealed slat 16 exposed to the viewer.

This formula may now be applied to the preferred embodiment illustrated in FIG. 10, where it is understood that increased and sufficient counterweight 56 has been added proximate the rearward edge 40 of (W1) the rearward portion 44 of the slat 16 to increase the force of (M1) the effective rearward load 90 of the slat 16 which moves (D1), the effective distance of the rearward portion 44 rearwardly from the fulcrum or pivot point 46. Consequently, the center of balance 86 of the slat 16 moves to a position well behind pivot point 46 and thereby forces the forward edge 32 of the slat 16 to rotate to a full upwardly disposed position when the tilt member 22 is relaxed and fully lowered to provide a partially closed plurality of overlapping slats 16 that prevent a direct view therethrough but permit air and light to pass freely through spaced apart openings between slats 16 (see, FIG. 2).

Briefly stated in terms of a formula, in the illustrative preferred embodiment depicted in FIG. 10 where D1 and D2 are dissimilar, $W1 \times D1 > W2 \times D2$ or, $M1 > M2$.

To explain the formula in greater detail, FIG. 13 shows a slat 16 having a support member 20 located rearward of the slat's center-of-dimension 80 or centerline. The slat's 16 center-of-balance 86 is just slightly rearward of the support member 20 due to the added weight 56 proximate the rear edge 40 of the slats 16 in the form of a continuous length of insert material 96 and the tilt member 22. The vertical tilt member 22 is rearward of the center-of-balance 86 and is also proximate the slat's 16 rear edge 40. The slat's 16 rotational pivot point or fulcrum 46 is the center of the node 98 on the support member 20 and the portion 42 of the slats 16 forward of the support member 20 is represented by forward mass 88 and is dimensionally longer but slightly lighter in total weight than is the portion 44 of the slat rearward of the support member 20 which is represented by rearward mass 90 and is dimensionally shorter but slightly heavier in total weight.

The distance on both sides of the pivot point 46 or support member 20 correlate with the slat's 16 portion of weight on both sides of the support member 20. Consequently the mass rearward of the support member 20 may be indicated as 90 and the mass forward of the support member 20 may be indicated as 88. If the weight on either side of the support member 20 were equally distributed, as would be the case in a constant wall thickness material, then the center-of-mass 90 or 88 of that portion of the slat 16 would be at that portion's centerline or mid-point. The rearward portion 44 of the slat 16 has unequal wall thickness and has a mass of dissimilar material 92 added whereby that portion's center-of-mass 90 will effectively be caused to fall rearward of that portion's 44 centerline or midpoint.

The portion 42 of the slat 16 forward of the support member 20 is of constant wall thickness and has no openings, therefore that portion's 42 center-of-mass 88 will be at that portion's 42 centerline or mid-point. The portion 44 of the slat 16 rearward of the support member 20 has material and weight removed in the form of an opening 39, however that portion 44 also has a substantial mass of dissimilar material 92 proximate that portion's 44 rear edge 40 which much more than compensates for the loss of weight of opening 39 such that that portion's 44 center-of-mass 90 will effectively fall rearward of that portion's 44 centerline or mid-point.

When the slat's 16 rearward portions 44 are counterweighted 56 at their rearward most edges 40 with weight sufficient to create a slightly greater mass 90 rearward of the support member 20, rotational forces will act on them causing them to naturally rotate downward about the support member 20, the slat's 16 forward portions 42 having slightly lesser mass 88 resulting in lesser rotational forces acting on them causing them to naturally rotate upwardly about the support member 20, thereby causing the slat 16 in its entirety to assume the desired position slightly upward of full open-to-view.

The disposition of the individually counter-weighted 56 slats 16 to rotate counter-clockwise can be overcome with the addition of a vertically oriented tilt member 22 which itself adds effective weight to the rear portion 44 of slat 16 positioned anywhere behind the center-of-balance 86, (the most efficient position being proximate the rear edge 40 of each slat 16), so that when elevated the tilt member 22 will lift the nominal mass differential between the slat's two portions 90 and 88, and thereby cause the forward edges 32 of an upper slat 16 to contact and seal with the upper surface of an adjacent slat 16 below concealing both the support and tilt members 20 and 22 and the lift-cords 26 from interior view.

The necessary added weight 56 proximate the slat's 16 rear edge 40 is most efficiently added as far rearward as possible. The farther to the rear the weight is added, the less weight 56 will be required as the weight's 56 center-of-mass 90 is caused to be further rearward from the point of support or the fulcrum 46.

Figure 14:
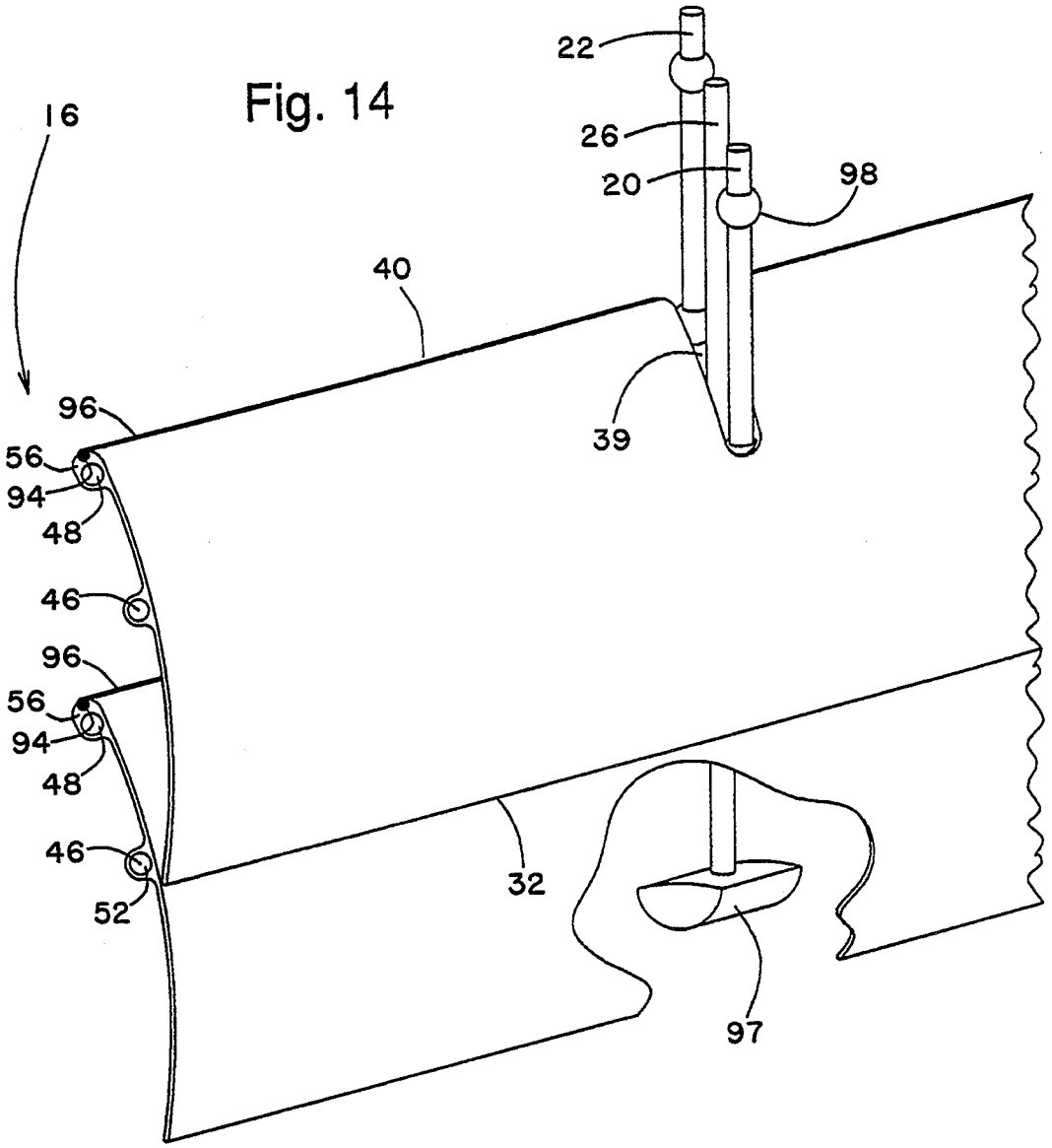
FIG. 14 is a perspective view of a detail view of another embodiment of the invention showing the slats in the fully tilted downward or sealed position.

In another embodiment, the slats 16 illustrated in FIG. 14 are extruded preferably of plastics material, and have an undercut opening 94 proximate the rear edge 40. This undercut opening 94 has a rearward facing open portion of lesser dimension than is the interior diameter dimension of the undercut opening 94 to accommodate in a snap-fit fashion a similarly shaped insert 96 to act as additional counterbalance weight 56. This insert 96 can be either continuous or can be segmented and is also more dense than is the remainder of the slat's 16 material.

In this embodiment, the vertical members 20 and 22 include rigid nodes 98 similar to those depicted in FIG. 11 which can be injection molded or press-fit onto through the tilt and support members 22 and 20 at equal and continuous increments. The size and shapes of the nodes 98 are compatible with snap-fitting them into the opening 39 between the two channels 48 and 52 on the bottom sides of the slats 16.

When no bottom-rail 14 is utilized as is the case in this embodiment, the lift-cords 26 can be attached to one another (not shown) below the bottom most slat 16 or can have knots or a terminal device 97 attached to each independent lift-cord 26 that are larger than the openings for the lift-cords 26 to prevent the lift-cords 38 from being pulled through the aligned openings 38 and to provide a large enough contact surface to not bend or deflect the lifted slats 28.

Figure 15:
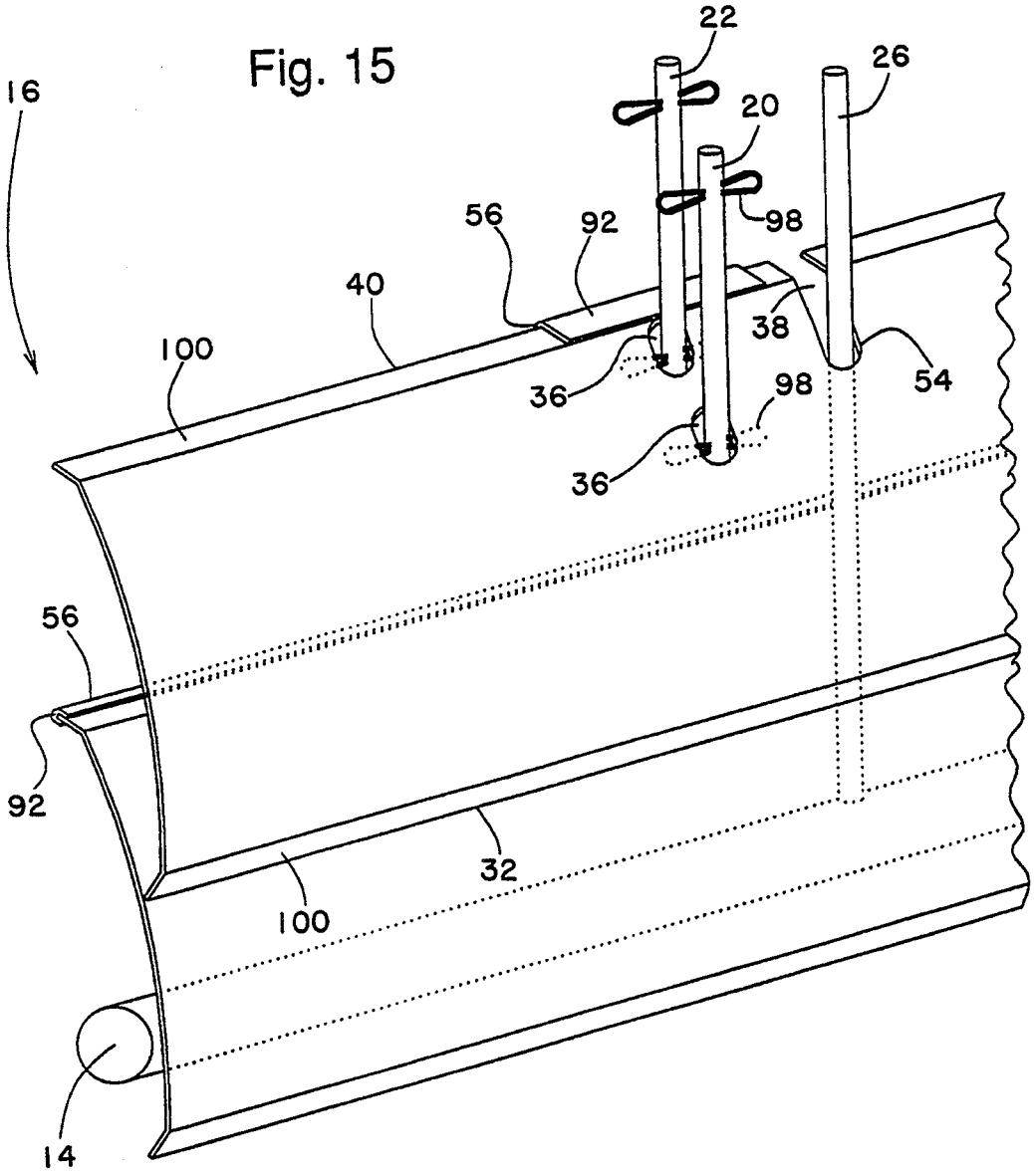
FIG. 15 is a perspective view of a detail view of another embodiment of the invention showing the slats in the fully tilted downward or sealed position.

Referring now to FIG. 15 there is shown in a perspective detail view, a further embodiment of the slats 16 and a vertical system 18 of the invention. The slats 16 are crowned and have a downwardly disposed break or chamfer 100 proximate the slat's 16 forward and rearward edges 32 and 40. The slats 16 are manufactured of a constant wall thickness material and have counterbalance weight 56 added to their rearward edges 40 in several ways. Of the two slats illustrated, the upper slat 16 shows a short segment of counterbalance weight 56 frictionally attached to the slat's 16 rearward chamfer 100. This counterbalance weight 56 can be of similar material to the slat 16 or can be of dissimilar material 92 preferably a more dense or heavier material. The lower of the two slats 16 illustrated shows a counterbalance weight 56 frictionally attached to the slat's 16 rearward chamber 100. In this example, the additional weight 56 is generally continuous and is therefore somewhat smaller in cross-sectional profile as its lack of bulk is compensated for by its relative length. In either case, the counterbalance weight is adequate to cause the rearward portion 44 of each slat 16 to weight somewhat more than the slat's 16 forward portion 42.

FIG. 15 also shows a support member 20 of the vertical system 18 passing through aligned openings 36 and a tilt member 22 passing through separate aligned openings 36 in each slat 16. Unlike the previously illustrated embodiments, the openings 36 for the vertical members 20 and 22 are in forward to rearward alignment and are separated one from the other and do not allow the support member 20 and the tilt member 22 to invade the opening 36 occupied by the other.

Both vertical members 20 and 22 have equally spaced nodes 98 that are preferably integrally woven or knitted into the vertical members 20 and 22. The nodes 98 are flexible enough to be sequentially pulled through the aligned separate openings 36 in the slats 16, but are stiff enough to support the weight of each slat 16 thereby providing proper spacing and tilting of the slats 16.

The lift-cord 26 passes through aligned openings 38 in the rearward portion 44 of the slats 16. These openings 38 may exit the rearward edges 40 of the slats 16 or may be contained entirely within (not shown) the slat's 16 rearward portion 44. These openings 38 may exit the rearward edges 40 of the slats 16 or may have the rearward exit closed by the generally continuous counterbalance weights 56 as illustrated in the lower slat 16 of FIG. 10.

Figure 16:
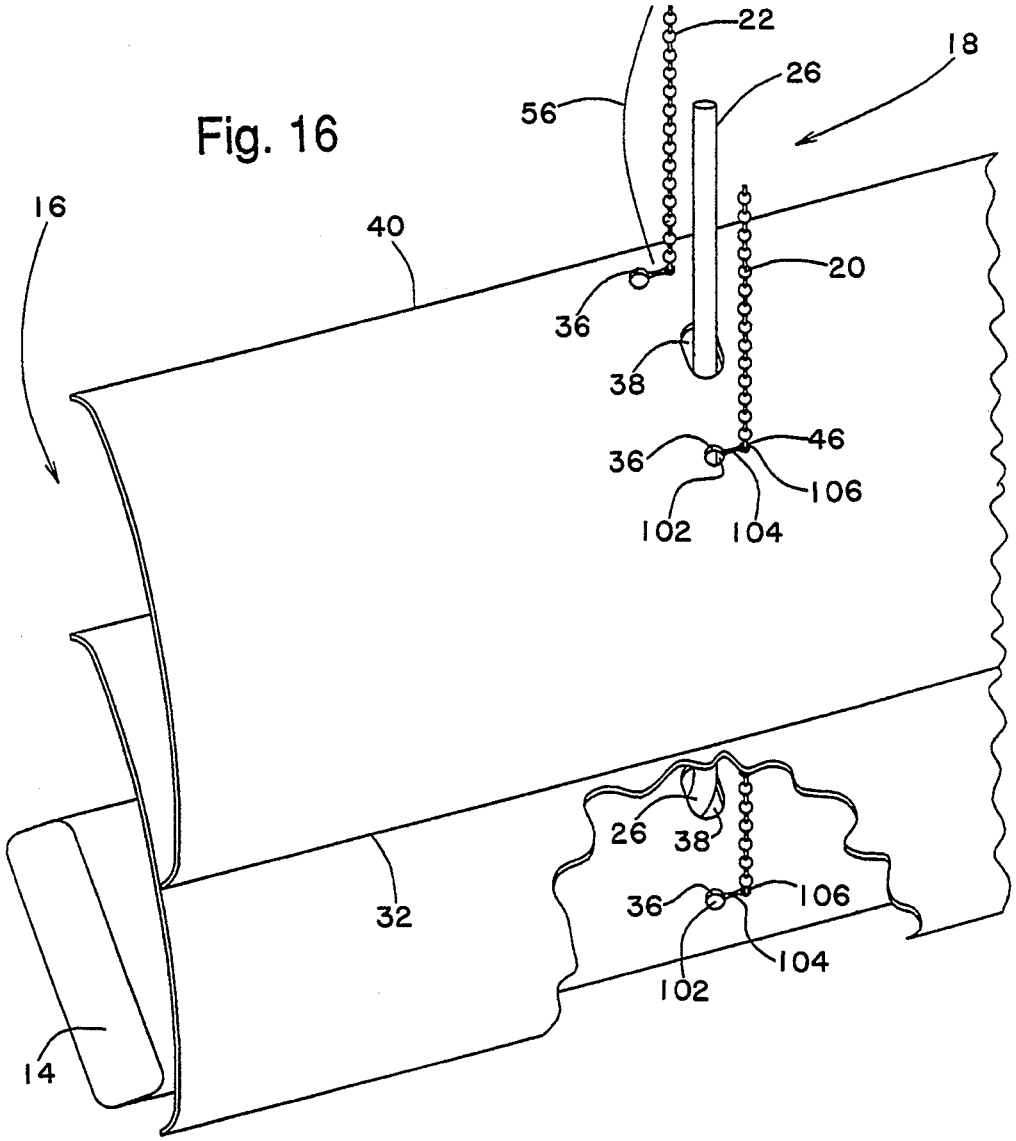
FIG. 16 is a perspective view of a detail view of another embodiment of the invention showing the bottom-rail and slats in the fully tilted downward or sealed position.

FIG. 15 also shows the lift-cord 26 attached to the bottom-rail 14 as described previously and in this embodiment the lift-cords 26 are in vertical alignment with the center of balance 54 of the slats 16. The bottom-rail's 14 point of contact with the slats 16 to be lifted is also at the slat's 16 center of balance 54. This point of support of the bottom-rail 14 and/or lift cord terminations such as depicted in FIG. 14 with the slats 16 to be lifted will cause the lifted slats (not shown) to remain generally horizontal and to generally not change angle from the full open-to-view position of the slat's 16 upper portion (not shown) which is also generally horizontal. In FIG. 16, a perspective detail view of the bottom-rail 14 and the slats 16 of the this embodiment of the invention are shown in the fully tilted downward or sealed position. Here, the components comprising vertical system 18 are in forward to rearward alignment and are all contained within the slat's 16 rearward portion 44. The illustrated lift-cord 26 and openings 38 are similar to other embodiments, but in this embodiment are attached to a bottom-rail 14. Under such circumstances, the bottom-rail 14 rotates or tilts simultaneously and consistently with the slats 16 as it is also operatively connected to the support member 20 and the tilt member 22.

This embodiment illustrates the vertical members 20 and 22 as flexible beaded chains similar to the pull-chains often associated with bare light bulbs. These beaded chain vertical members 20 and 22 pass through vertically aligned openings 36 in the slats 16 and the bottom-rail 14 which are configured in common keyhole shapes to allow the beaded chains 20 and 22 to readily pass through the larger side 102 of the opening 36 and then be indexed sidewardly through a small passageway 104 into the smaller side 106 of the opening 36 such that the slat 16 and the bottom-rail 14 will be supported, spaced and tilted by the beaded chains 20 and 22.

The beaded chain vertical members 20 and 22 are heavy enough that the rearward vertical member 22 or the tilt member 22 acts as the necessary counterbalance weight 56 to more that compensate for the cantilevered forward portion 42 of the slat 16. The counterbalance weight 56 of the beaded chain tilt member 22 is that portion of the beaded chain counterbalance weight 56 that lies below the effectively weighted slat 16 and above the next lower slat 16. This dimension of effective counterbalance weight 56 of the beaded chain tilt member 22 between slats 16 is the same as the vertical spacing between slats 82.

While the weight of a segment of the rearward tilt member 22 provides the necessary counterbalance weight 56 to each slat 16, the forward support member's 20 similar weight has no effect on the slat 16 as it passes through aligned openings 36 at the slat's 16 pivot point or fulcrum 46 and therefore does not effectively add weight to either the slat's forward portion 42 or rearward portion 44. Thus, both vertical members 20 and 22 can be identical while only the rearward tilt member 22 adds any counterbalance weight 56 to the slat's 16 rearward portion 44 while the forward support member 20 has no effect.

Greater overall weight efficiencies of the device can be achieved by using for support members 20 either pull-chains made from lighter weight materials like plastics or braided members with nodes 98 (for example, as shown in the previous embodiment) in combination with heavier weight pull-chain materials like metals for use as tilt members 22. It should be understood that a plurality of vertically oriented suspended counterweights 56 can be employed to achieve the desired results and that not all vertically oriented counterweights 56 need be operatively connected to the tilt bar 64 in the head-rail 12 and serve as tilt members 22.

The slats 16 in this embodiment are quite highly crowned such that when the slats 16 in the lower portion 28 are lifted, there is adequate space between slats 16 to accommodate the now relaxed and folded beaded chain vertical members 20 and 22 in the void spaces between the lifted slats 28.

Figure 17:
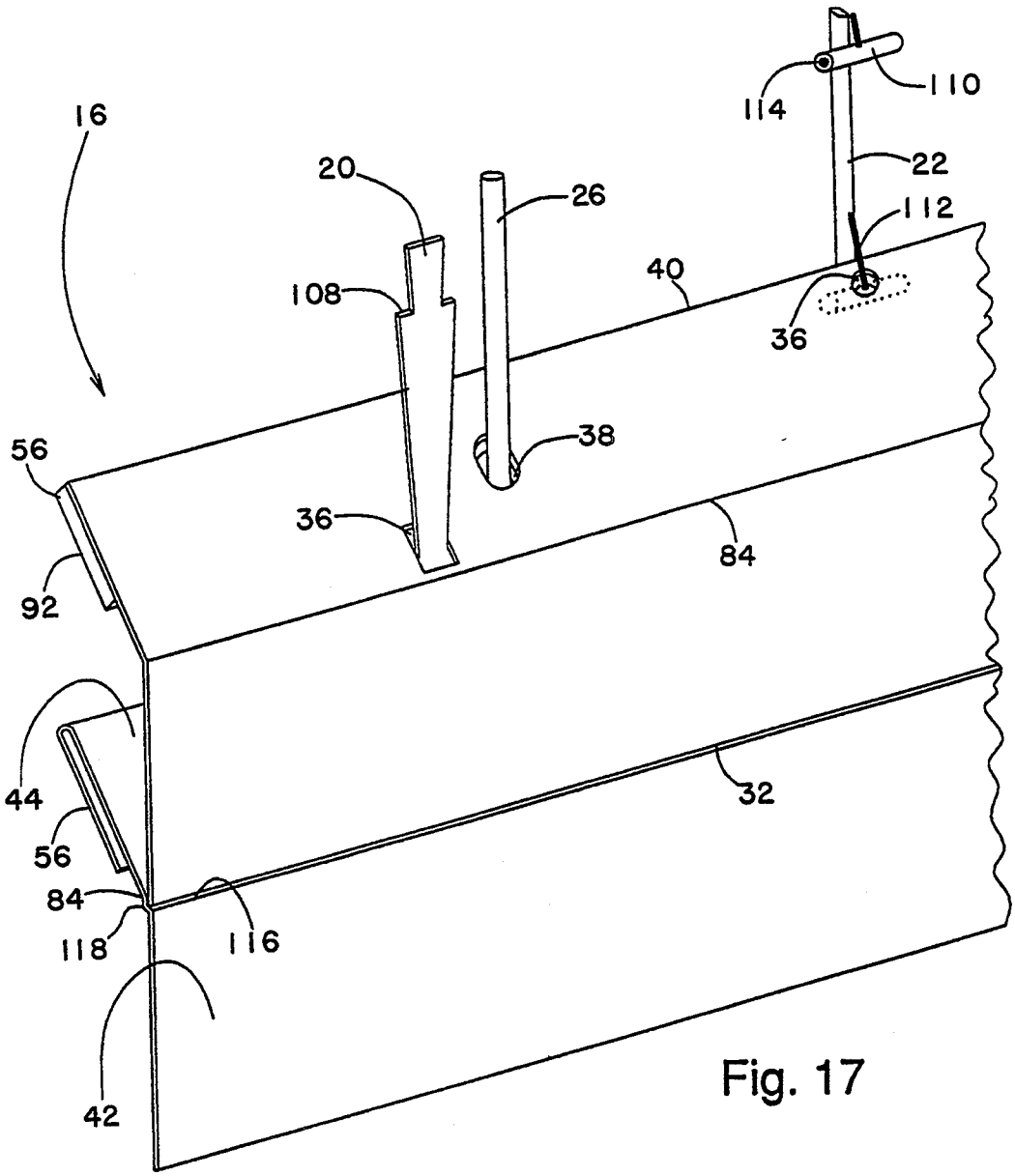
FIG. 17 is a perspective view of a detailed view of another embodiment of the invention showing the slats in the fully tilted downward or sealed position.
Figure 18:
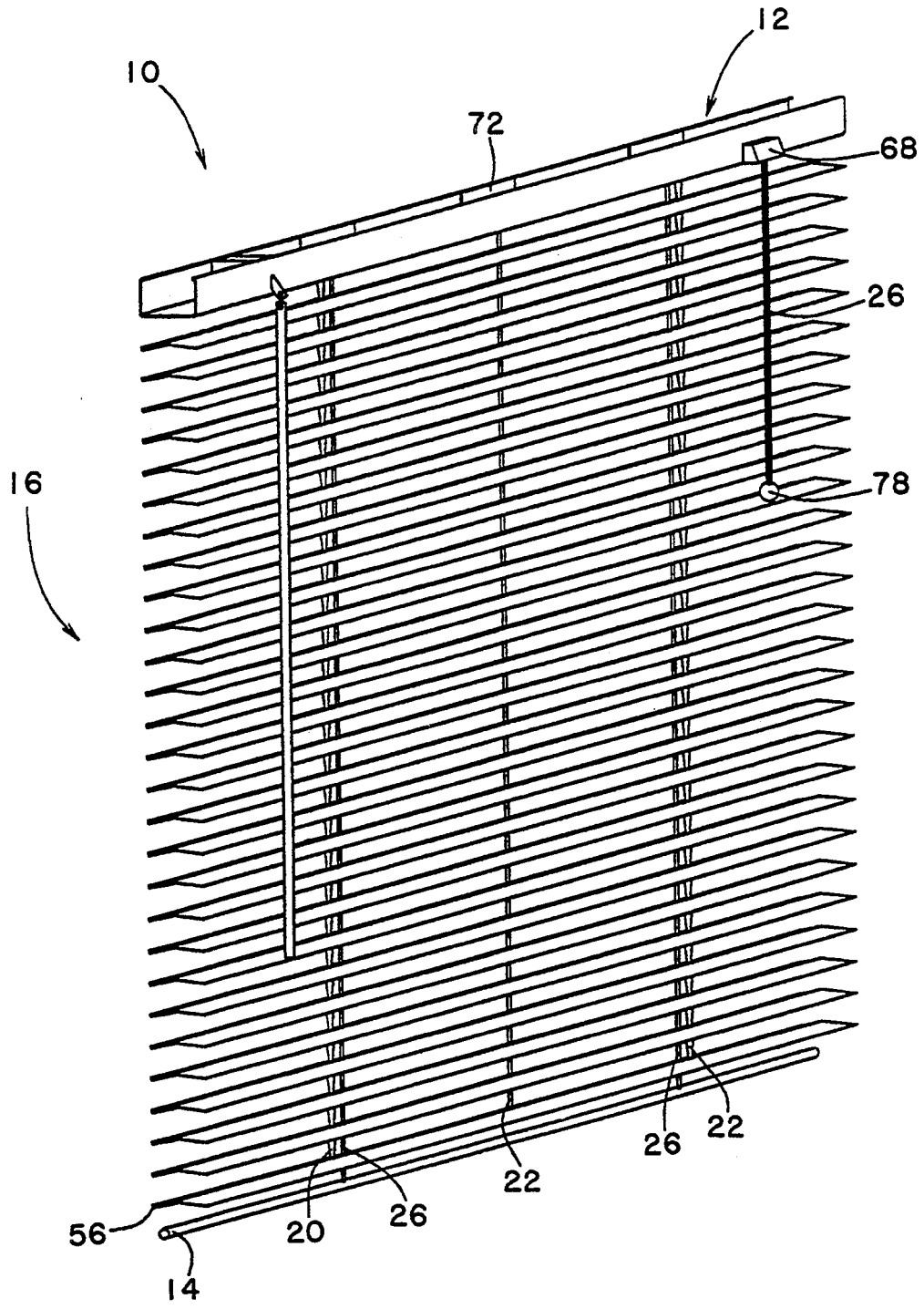
FIG. 18 is a perspective view of a general view of the blind of FIG. 17 in a fully lowered position with the slats in the full open-to-view position.

Referring now to FIGS. 17 and 18, there is shown an embodiment of the invention, wherein the vertical system 18, includes a pair of lift-cords 26, a pair of support members 20 and a single tilt member 22.

In the detailed perspective view of FIG. 17 the slats 16 are in the fully tilted downwardly or sealed position. The slats 16 in this embodiment are crowned by the merging of two generally flat sections that merge rearward of the slat's 16 overlap point 84. The slats 16 have a counterbalance weight 56 attached to the lower surface of their rearward portion 44 proximate their rearward edges 40 by adhesive or other suitable method. The upper slat 16 depicted in this illustrative embodiment shows the weight 56 as continuous but may be segmented (not shown) and may be of either similar or dissimilar material to that of the slat 16. The required weight 56 may be an additional width of slat material as depicted in the embodiment shown in the lower slat 16 and may be compressed or folded under or over itself and be anchored or adhered to itself by suitable mechanical or adhesive means. Additionally, the lower slat 16 embodiment depicts a concave longitudinal channel 116 in its upper surface having a depth in excess of the thickness of the forward edge 32 of the slat 16 and a similarly imaged convex longitudinal channel 118 on its lower surface. The longitudinal channels 116 and 118 are located proximate the slat's 16 overlap point 84 such that when the slats 16 are in their sealed position, the forward edge 32 of an upper slat 16 engages the concave channel 116 of a lower slat 16. The overlapping and engaging slat 16 arrangement provides additional light blocking capability should there be any minor irregularity in the forward edge 32 or surface of any slat 16 and provides as well, a generally flush vertical interior surface when a plurality of like slats 16 (not shown) are tilted to their sealed position.

The lift-cords 26 and openings 38 are similar to previously described embodiments while the vertical members 20 and 22 are quite different from other illustrative embodiments and from each other. Each of the pairs of forward support member 20 is saw-toothed in configuration and includes shoulders or lands 108 to provide support and spacing for each slat 16. The shoulders or lands 108 are spaced at increments equal to the slat's 16 desired vertical spacing 82. This saw-toothed support member 20 passes through aligned openings 36 that are generally rectangular such that the saw-toothed support member 20 can be vertically rotated about 90 degrees for ease of insertion in the longer dimension of the rectangular opening 36, then re-oriented about 90 degrees such that the shoulders or lands 108 of the saw-toothed support member 20 engages the lower surface of the slats 16 proximate the shorter dimension of the rectangular openings 36.

The saw-toothed support members 20 also can include integral hinges or weak sections that facilitate and control the member's 20 rearward folding when compressed between lifted slats 28.

The single tilt member 22 is centrally positioned between the members and is proximate the rearward edges 40 of the slats 16, preferably just outside the rearward edges 40 of the slats 16. The tilt member 22 is an integrally woven or knitted member and includes short segments 110 which also can a knitted or woven construction. These segments 110 can be stiffened with a rigidizing member 114 or by other suitable means such as sizing so that when the segments 110 are inserted into the opening 36 and are upset they will be of sufficient stiffness to support the weight of the slat 16 and will not readily pull out of the opening 36. The segments 110 are attached to the other continuous vertical rail of the ladder by a rung 112 or smaller section.

Thus, the two vertical members 20 and 22 can be configured to individually serve their own specific function of support member 20 and tilt member 22. Additionally, FIG. 17 illustrates that the tilt member 22 is by comparison to other embodiments spaced quite far from the support member 20. This is to illustrate that a total combination of three vertical members 20 and 22 is all that is required, especially on long and narrow blinds 10 such as those typically found adjacent to a home's front door where the blind's 10 width may be only 8 or 10 inches.

The three vertical members form a triangulation (see, FIG. 18) to adequately support, space and tilt the slats 16 and can be any combination of two support members 20 and one tilt member 22, or two tilt members 22 and one support member 20. The single member 20 or 22 will usually be spaced half way between the pair of members 20 or 22.

FIG. 18 shows a blind 10 of this embodiment in the fully lowered position with the slats 16 in the full open-to-view position. In this view it can be seen that there can be a bottom-rail 14 which in this example is suspended from the lift-cords 26 and does not rotate with the slats 16 as the bottom-rail 14 is independent of the slats 16. This figure shows a preferred arrangement of a single tilt member 22 in a central vertical location and two support members 20 and two lift members 26 located proximate each other in a narrower blind 10.

Figure 19:
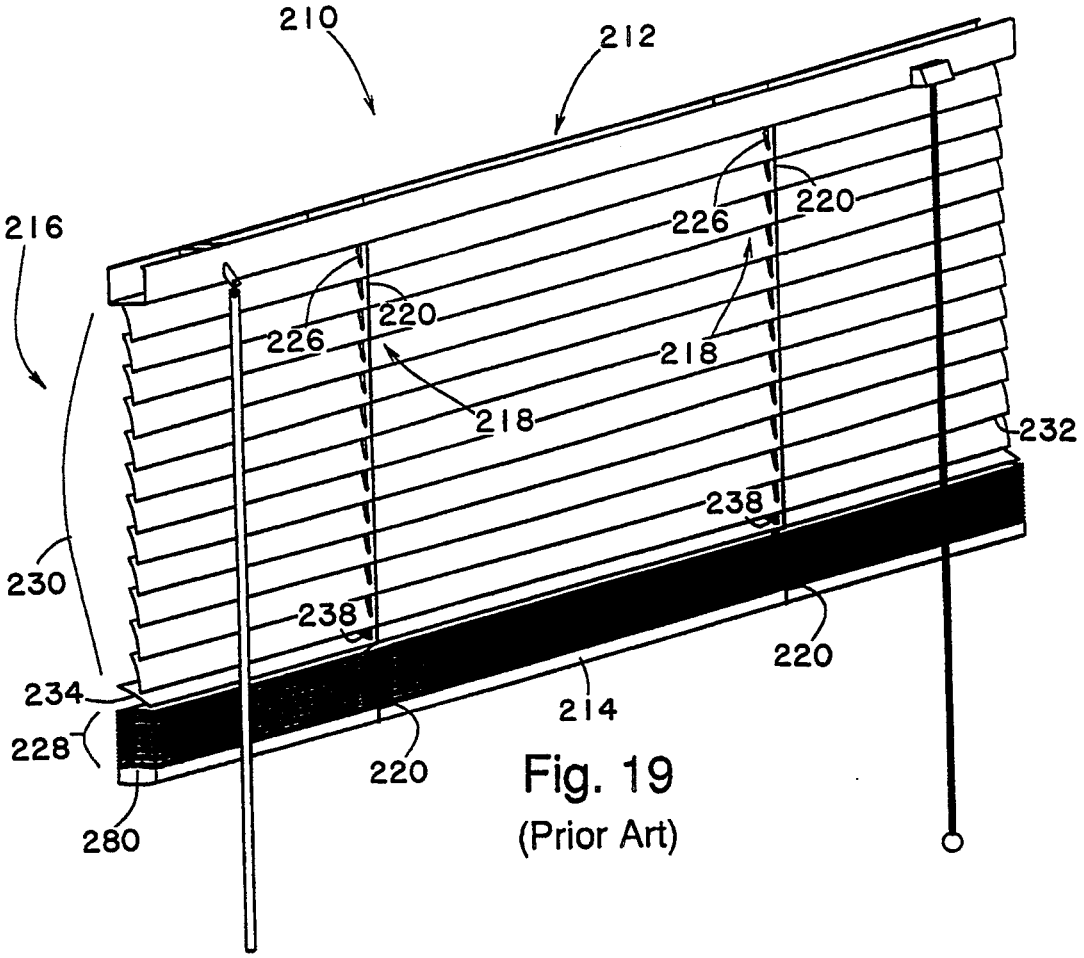
Fig. 19 (Prior Art)
FIG. 19 is a perspective view of a general view of a prior art blind in a partially raised position with the slats in the fully tilted downwardly or sealed position.
Figure 20:
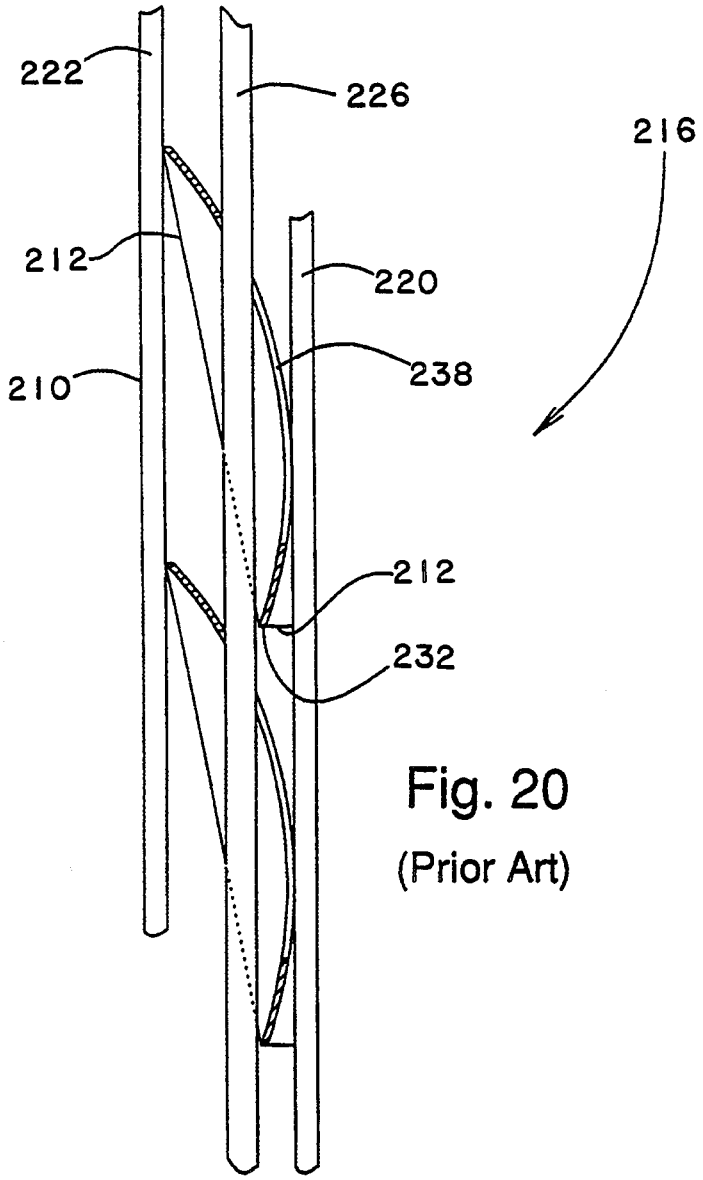
Fig. 20 (Prior Art)
FIG. 20 is a section view of a detail view of a prior art blind showing the slats in the fully tilted downwardly or sealed position.

In FIGS. 19 and 20, a conventional prior art blind 210, with a conventional head-rail 212, and bottom-rail 214, is illustrated. In FIG. 19, the prior art blind is in the partially lowered position with the slats in the fully downwardly position. It can be seen that in conventional blinds 210, with the exception of the one transition slat 234, the lifted slats 228 assume a generally horizontal position as the bottom-rail 214 is usually symmetrical and is usually lifted at its centerline 280, therefore there is nothing to cause the bottom-rail 214 or the lifted slats 228 to assume any other position other than generally horizontal. It can be seen that the slats 216 of this conventional blind 210 have been rotated to a fully, sealed position but have failed to have the front edges 232 of the slats 216 contact adjacent lower slats 216 and thereby prevent light leakage between adjacent slats 216. The lift cords 226 are readily visible passing through the openings 238 that permit additional light leakage and prevent privacy in the upper portion 230 of the slats 216 that have been rotated to a sealed position. The forward vertical support members 220 are also visible in the upper portion 230 of the slats 216 that have been rotated to a sealed position and are even more obtrusive as they typically form a folded zigzag pattern in front of the lower portion 228 of the compressed elevated slats 216.

In FIG. 20, a detail view of the conventional blind 210 is illustrated with the slats 216 in the fully tilted downwardly position. It can readily be seen that there are two major factors that prevent the slats 216 from actually coming into contact one with another. One factor is the lift-cord's opening 238 is not long enough to allow the slat 216 to tilt further. The lift-cord 226 has come into contact with the rearward edge of the lift-cord opening 238 while the forward edge 232 of the slat 216 has come into contact with the lift-cord 226 preventing further tilting or rotation of the slats 216 about the vertical lift-cords 226. Lengthening the lift-cord opening 238 to allow further rotation of the slat 216 is generally not possible as the opening's 238 current length has removed a majority of the slat's 216 forward to rearward dimension and already substantially weakened the slat 216 such that this is a common point of slat 216 bending or failure. Additionally, any lengthening of this lift-cord opening 238 simply allows more undesirable light leakage and increases the size of the peep holes 238. The second factor is the rungs 212 in the conventional blind's 210 ladder that always separate the slats 216 must run between the slats 216 in order to provide support, spacing and tilting. So both of the independent vertical systems 220 and 222, and 226 contribute to the conventional blind's 210 slat's 216 inability to physically contact a contiguous slat 216 and provide complete room darkening and complete privacy.

FIGS. 19 and 20 demonstrate that a minimum of four of the vertical systems members 218 are visible from the interior of the environment, as are the lift-cords 226 respective openings 238. In wider blinds 210 where there are more elements to the vertical systems 218, more vertical members 218 and openings 238 will be visible.

FIG. 19, the prior art, can be contrasted with FIG. 5, a preferred embodiment of the present invention, to demonstrate the contribution of the present invention in eliminating from interior view the vertical systems members 18 and their respective openings 36 and 38 providing room darkening, privacy and a cleaner, more attractive appearance.

The embodiments previously described are not limited to any specific materials or processes and can be readily adapted to conform to the present invention in plastics, metals, woods, or other appropriate materials and can be manufactured by roll-forming, thermo-forming, extruding, milling or other appropriate processes.

The invention in its broader aspects is not limited to the specific described embodiments and departures may be made therefrom within the scope of the accompanying claims without departing from the principles of the invention and without sacrificing its chief advantages.

What we claim is:

1. A Venetian blind, comprising:

(a) a plurality of slats including cantilevered forward portions and opposing rearward portions having weighted means for countering said cantilevered forward portions, wherein said slats are tiltable from an open viewing position to a forwardly tilting overlapping fully sealed position for room darkening and for privacy, (b) a vertical system disposed rearward of said cantilevered portions of said slats wherein said system includes aligned openings through which at least a portion of said vertical system passes for spacing, supporting and tilting said slats and for raising and lowering the slats independently of the position of the slats, and (c) wherein said rearward vertical system and aligned openings are hidden from the forward view of said slats when the slats are in their overlapping fully sealed position.

2. The blind of claim 1, wherein said vertical system includes a forward vertical member operatively connected to said slats rearwardly of the center line of said slats and a rearward vertical member operatively connected proximately to said rearward edges for spacing, supporting and tilting said slats.

3. A Venetian blind having a headrail, comprising:

(a) a plurality of slats depending from the headrail having forward and rearward edges and aligned openings in a rearward portion thereof of said slats;

(b) a plurality of vertical members depending from the head-rail utilized in the spacing, supporting and tilting of said slats at least between an open position for viewing through said slats and a fully sealed position, and wherein said members include a vertical forward member operatively connected to said slats which extends through said aligned openings therein and between said edges thereof and a vertical rearward member operatively connected to said slats proximate the rearward portions thereof;

(c) independent raising and lowering means depending from the head-rail and independent of said vertical members, wherein said independent raising and lowering means are operatively connected to the rearward portion of said slats regardless of their tilted position for raising or lowering said slats; and (d) each of said slats having a forward cantilevered portion greater than half the dimensional width of said slat which is disposed forward of said forward vertical member toward the interior of a room in which the blind is to be used, and having weighted means at the rearward portion of said slat for countering said forward portion, and wherein said slats are spaced apart a distance from one another such that when said slats are tilted to the fully sealed position they overlap and contact one another to block the view of said members, said openings and said independent raising and lowering means from a forward view of said slats and for room darkening and privacy.

4. The blind of claim 3, wherein said include forward edges, rearward edges and pivot points therebetween wherein said forward edges are below the pivot point and the rearward edges are at or below a plane passing through said pivot points, and wherein said pivot points are located rearwardly of the dimensional center of the slats.

5. The blind of claim 3, wherein said weighted means comprises weight added to said rearward portions thereof to cause said slats to tilt upwardly because said forward cantilever portions are lighter than the weighted rearward portions.

6. The blind of claim 3, wherein said weighted means comprises weight added to said rearward portions thereof to cause said slats to be in the open for viewing position because said cantilever portions are essentially the same weight as the rearward portions.

7. The blind of claim 3, wherein said vertical rearward member is for tilting said slats, and wherein said vertical forward member is for spacing and supporting said slats.

8. The blind of claim 3, wherein said weighted means at the rearward portion of said slats is integral therewith.

9. The blind of claim 3, wherein said weighted means at the rearward portion of said slats is operatively connected thereto.

10. The blind of claim 3, wherein said weighted means at the rearward portion of said slats is integral with said vertical rearward member.

11. The blind of claim 3, wherein said independent raising and lowering means includes a lift cord.

12. The blind of claim 3, wherein the aligned openings in said slats are adapted to have the vertical members extend therethrough.

13. The blinds of claim 3, wherein said aligned openings in said slats are adapted to have said vertical members and a lift cord extend therethrough.

14. The blinds of claim 3, wherein said slats have a pair of aligned openings, one for said vertical members and one for said independent raising and lowering means.

15. The Venetian blind of claim 3, wherein said vertical members include laterally extending pins spaced apart from one another and along the lengths of said vertical members, and wherein said slats include grooves therein for receiving said pins for spacing, supporting and tilting said slats.

16. The Venetian blind of claim 3, wherein said weighted means comprises weights embedded in the rearward portions of said slats, wherein said vertical members have spaced apart nodes along the lengths of said vertical members, and wherein said slats include channels for receiving said nodes for spacing, supporting and tilting said slats.

17. The Venetian blind of claim 3, wherein said weighted means comprises weights added to the rearward portions of said slats, and wherein each of said vertical members includes flexible nodes which can be flexed to sequentially pull said nodes through the aligned openings in said slats for each of said vertical members, to thereby space and support said slats and for tilting said supported slats.

18. The Venetian blind of claim 3, wherein said vertical members are flexible beaded chains insertable through said aligned openings in said slats for spacing, supporting and tilting said slats.

19. The Venetian blind of claim 3, wherein the blind includes two pairs of spaced apart vertical members for supporting said slats and one vertical member intermediate said vertical members for tilting said slats.

20. The Venetian blind of claim 19, wherein said vertical supporting members have a saw-tooth configuration with shoulders thereon spaced along the length of said vertical supporting members which engage, space and support said slats.

21. The Venetian blind of claim 3, wherein the blind includes a non-tilting bottom rail at the lower end of said slats, and wherein said independent raising and lowering means is a vertical lift cord connected to said bottom rail.

22. The Venetian blind of claim 3, wherein the blind includes a tiltable bottom rail at the lower end of said slats, wherein said independent raising and lowering means is a lift cord, and wherein said vertical members and lift cord are connected to said bottom rail.

23. The Venetian blind of claim 3, wherein said vertical members and said independent raising and lowering means terminate at and are connected directly to the lower most of said slats for tilting and raising and lowering said slats.

24. A Venetian blind, comprising:

(a) a plurality of slats each of which includes a forward cantilevered portion and a rearward portion with a pivot point located therebetween, said rearward portion having a weighted means for countering said forward cantilevered portion whereby the weight of said rearward portion of each said slat multiplied by the weight's effective distance from said pivot point is substantially equal to the weight of said forward cantilevered portion of each said slat multiplied by the weight's effective distance from said pivot point is substantially equal to the weight of said forward cantilevered portion of each said slat multiplied by the weight's effective distance from said pivot point, wherein said slats are tiltable from an opening viewing position to a forwardly tilting overlapping fully sealed slat contacting position for room darkening and privacy, (b) a vertical system disposed rearward of said cantilevered portions of said slats wherein said system includes aligned openings through which at least a portion of said vertical system passes for spacing, supporting and tilting said slats and for raising and lowering the slats independently of the position of the slats, and (c) wherein said rearward vertical system and aligned openings are hidden from the forward view of said slats when they are in their overlapping fully sealed position.

25. A Venetian blind, comprising:

(a) a plurality of slats each of which include a forward cantilevered portion and a rearward portion with a pivot point located therebetween, said rearward portion having a weighted means for countering said forward cantilevered portion whereby the weight of said rearward portion of each said slat multiplied by the weight's effective distance from said pivot point exceeds the weight of said forward cantilevered portion of each said slat multiplied by the weight's effective distance from said pivot point, wherein said slats are tiltable from a rearwardly tilting partially sealed position for air and light passage to a forwardly tilting fully sealed slat contacting position for room darkening and privacy, (b) a vertical system disposed rearward of said cantilevered portions of said slate wherein said system includes aligned openings through which at least a portion of said vertical system passes for spacing, supporting and tilting said slats and for raising and lowering the slats independently of the position of the slats, and (c) wherein said rearward vertical system and aligned openings are hidden from the forward view of said slats when they are in their fully sealed position.

* * * * *